US006241600B1

(12) United States Patent
Uehara

(10) Patent No.: US 6,241,600 B1
(45) Date of Patent: Jun. 5, 2001

(54) VENTILATION DEVICE

(76) Inventor: Kiyomasa Uehara, 6-1 Kyohara-cho, Naha-shi, Okinawa (JP)

( * ) Notice: Subject to any disclaimer, the term of this patent is extended or adjusted under 35 U.S.C. 154(b) by 0 days.

(21) Appl. No.: 09/404,106

(22) Filed: Sep. 23, 1999

(51) Int. Cl.[7] ..... F24F 7/007
(52) U.S. Cl. ..... 454/252; 454/235; 454/244
(58) Field of Search ..... 454/252, 235, 454/244, 249, 205, 207

(56) References Cited

U.S. PATENT DOCUMENTS

| | | | | |
|---|---|---|---|---|
| 2,679,795 | * | 6/1954 | Gieger | 454/252 |
| 2,732,027 | * | 1/1956 | Wallin | 454/252 |
| 3,472,148 | * | 10/1969 | Winnett | 454/235 |
| 3,722,395 | * | 3/1973 | Courchesne | 454/235 |
| 4,336,748 | * | 6/1982 | Martin et al. | 454/235 |
| 5,334,091 | * | 8/1994 | Shih-Chin | 454/210 |

* cited by examiner

*Primary Examiner*—Jiping Lu

(74) *Attorney, Agent, or Firm*—Muramatsu & Associates

(57) ABSTRACT

A ventilation device is provided with a plurality of fans, each of the fans is rotated in a different direction to one another so that exhaust of inside air and intake of outside air can be conducted at the same time. Preferably, the ventilation device includes a tubular body extending between the inside and outside of the room where the tubular body installs a first fan therein at inside of the room and a third fan therein at about a middle thereof, an air duct for establishing an air flow path between inside and outside of the room, a fan compartment having a second fan therein where the second fan is inclined in a direction intermediate of a longitudinal direction of the air duct and a direction toward the first fan. The fan compartment establishes a first air passage to the tubular body through a first air hole and a second air passage to the air duct through a second air hole. The first and third fans stored in the tubular body rotate in a direction opposite to a rotating direction of the second fan stored in the fan compartment, thereby producing a first air flow which circulates inside of the room via the first air passage caused by the first and second fans, a second air flow passing through the air duct via the second air passage caused by the second fan, and a third air flow passing through the tubular body caused by the first and third fans.

8 Claims, 21 Drawing Sheets

VENTILATION DEVICE

FIELD OF THE INVENTION

This invention relates to a ventilation device for promoting air flows, and more particularly, to a ventilation device having a plurality of fans for producing air flows in opposite directions to one another.

BACKGROUND OF THE INVENTION

A conventional ventilation device is provided with a single fan which is rotated in a direction to ventilate a room by a air flow of a predetermined direction. However, if the room is in airtight condition, ventilation of the room is hindered due to the air resistance caused by such condition. Therefore, in order to effectively ventilate a room using a conventional ventilation device, a window or door of the room must be opened.

However, opening the window or door may cause dust or polluted air or even external noise coming in the room, which is unhealthy and unpleasant for people inside the room. Further, since the conventional ventilation device can only function to ventilate the air, another device or devices have to be used to clean the polluted air (air cleaner) and/or warm the air in the room (air conditioner).

SUMMARY OF THE INVENTION

Therefore, it is an object of the present invention to provide a ventilation device which can effectively ventilate a room in an airtight condition.

It is another object of the present invention to provide a ventilation device which can be used as an air cleaner or an air conditioner.

It is a further object of the present invention to provide a ventilation device which can produce two air flows in opposite directions to reduce air resistance when used in a room in an airtight condition.

It is a further object of the present invention to provide a ventilation device which can produce two or more air flows in directions different from one another to avoid interference between the air flows in either outside or inside of the room.

It is a further object of the present invention to provide a ventilation device which is able to achieve high ventilation efficiency with low cost.

In order to achieve the above objects, the present invention provides a ventilation device which is provided with a plurality of fans installed in the ventilation device wherein the plurality of fans are rotated in opposite directions to one another so that both incoming and outgoing air flows with the same or different degree are established.

The ventilation device preferably includes a first tubular body for mounting therein at least one of the fans, a second tubular body for mounting therein the other fan, a regulating plate for regulating a direction of the air flow, and an extending plate movably provided along an extended line of said regulating plate.

In another aspect, the ventilation device of the present invention for ventilating between inside and outside of the room includes a tubular body installing a first fan therein, an air duct for establishing an air flow path between the inside and outside of the room, and a fan compartment having a second fan therein wherein the fan compartment establishes a first air passage to the tubular body through a first air hole and further establishes a second air passage to the air duct through a second air hole, wherein the fan stored in the tubular body is rotated in a opposite direction from the rotating direction of the fan stored in the fan compartment. The ventilation device further includes a first plate to be inserted therein for either opening or closing the first air passage and a second plate to be inserted therein for either opening or closing the second air passage.

Preferably, the ventilation device of the present invention is provided with filters in combination with the fans for cleaning the polluted air in the room. The filter may be replaced with a heater so that the device can be used as a heating apparatus of the room.

According to the ventilation device of the present invention, the air resistance of the room caused in an airtight condition of the room by ventilation becomes small so that the room can be effectively ventilated.

Further, by providing air filters or heaters in combination with the plurality of fans, the ventilation device can be used as an air cleaner or an air conditioner.

DETAILED EXPLANATION OF THE PREFERRED EMBODIMENT

Referring now the drawings, the detailed explanation of the preferred embodiments of the present invention is given in the following.

Figure 1:
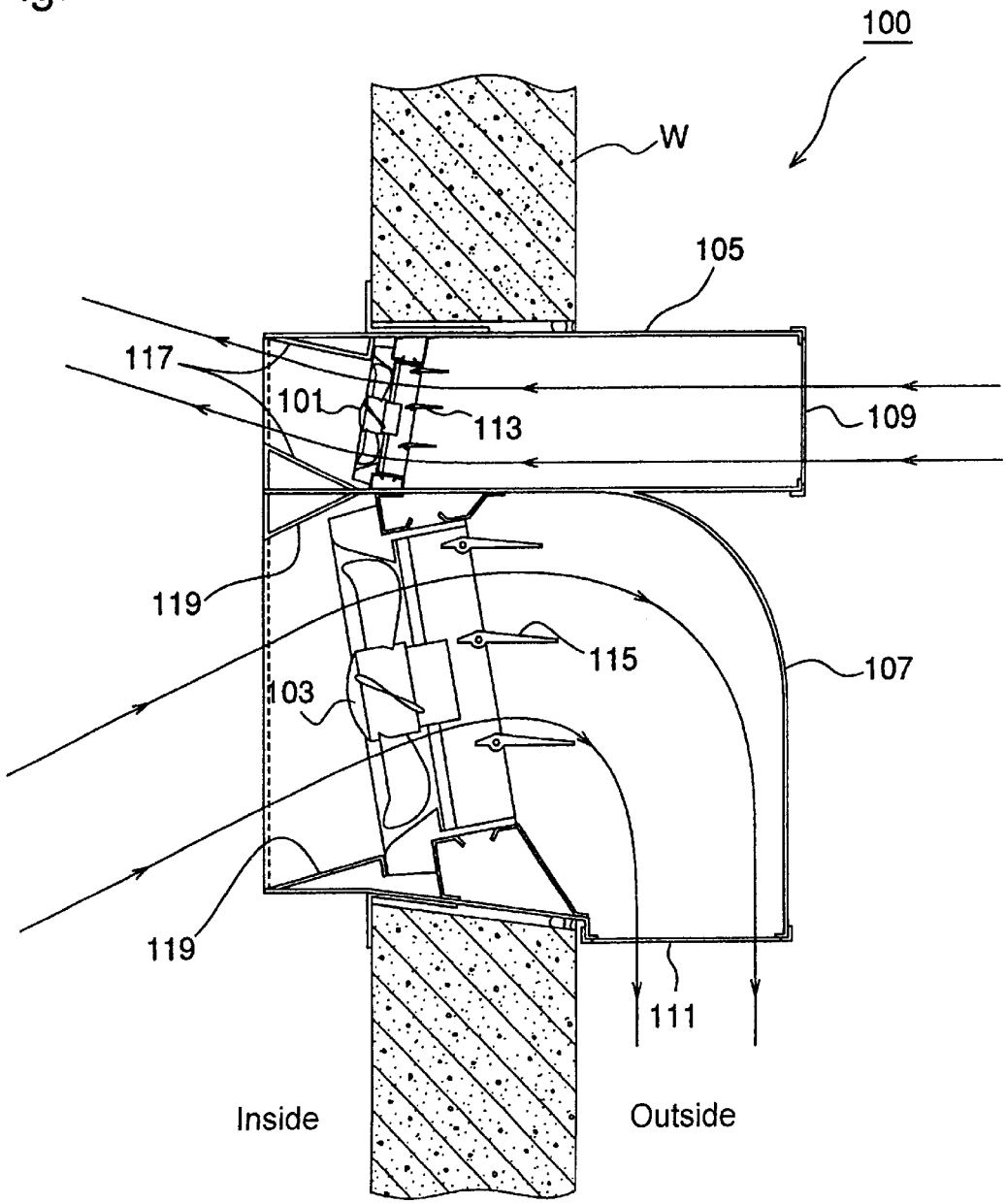
FIG. 1 is a cross sectional view of a ventilation device having a plurality of fans in the first embodiment of the present invention.

FIG. 1 is a cross sectional view of the first embodiment of the present invention. In this embodiment, a ventilation device 100 includes fans 101 and 103. The fan 101 is fixed to a tubular body 105 and the fan 103 is fixed to a tubular body 107. Preferably, the diameter of the fan 101 is smaller than that of the fan 103. Also preferably, the size of the tubular body 105 is smaller than that of the tubular body 107. The tubular body 105 has, for example, a square shape in cross section. Both ends of the tubular body 105 are opened, one end is at an inside ("inside opening") of a room while the other end is at an outside ("outside opening") of the room. A net 109 is provided at the outside opening.

The tubular body 107 has, for example, a square shape in cross section. Both ends of the tubular body 107 are opened, one end is at an inside ("inside opening") of a room while the other end is at an outside ("outside opening") of the room. The outside opening of the tubular body 107 is oriented in a downward direction and is provided with a net 111. Alternatively, outside opening of the tubular body 107 may be oriented in the horizontal direction like that of the tubular body 105.

The fan 101 is fixed to the tubular body 105 in a slightly upward direction relative to the horizontal line. The fan 103 is fixed to the tubular body 107 in a slightly downward direction relative to the horizontal line. The fans 101 and 103 are provided with shutters 113 and 115, respectively.

Regulating plates 117 are provided, at the top and bottom of the fan 101, in the inside opening of the tubular body 105 in an upwardly inclined direction to match the angle of the fan 101. Regulating plates 119 are provided, at the top and bottom of the fan 103, in the inside opening of the tubular body 107 in a downwardly inclined direction to match the angle of the fan 103. A detachable net or a detachable filter may be provided to each of the inside openings of the tubular bodies 105 and 107. Further, a heater as explained later (FIGS. 11–13) may be detachably provided to the inside opening.

In order to ventilate a room by using the ventilation device having the above noted configuration, the fan 103 is rotated in such a direction that the room air is exhausted outside of the room while the fan 101 is rotated in such a direction that the outside air is inhaled into the room. By this operation, the air of the room is exhausted to the outside of the room by the fan 103 through the tubular body 107 as shown in FIG. 1. On the other hand, the outside air is inhaled into the room by the fan 101 through the tubular body 105. Since the volume of exhausted air is larger than the volume of inhaled air, the room air is exhausted outside on the whole.

As explained above, since the air intake and air exhaust are conducted at the same time, the air resistance in an airtight room is decreased so that the airflows become smooth enough to achieve effective ventilation. It should be noted that the inclination of the fans 101 and 103 and the regulating plates 117 and 119 can be either forward and/or backward directions rather than upward and/or downward direction in the forgoing or mixtures all directions.

Figure 2:
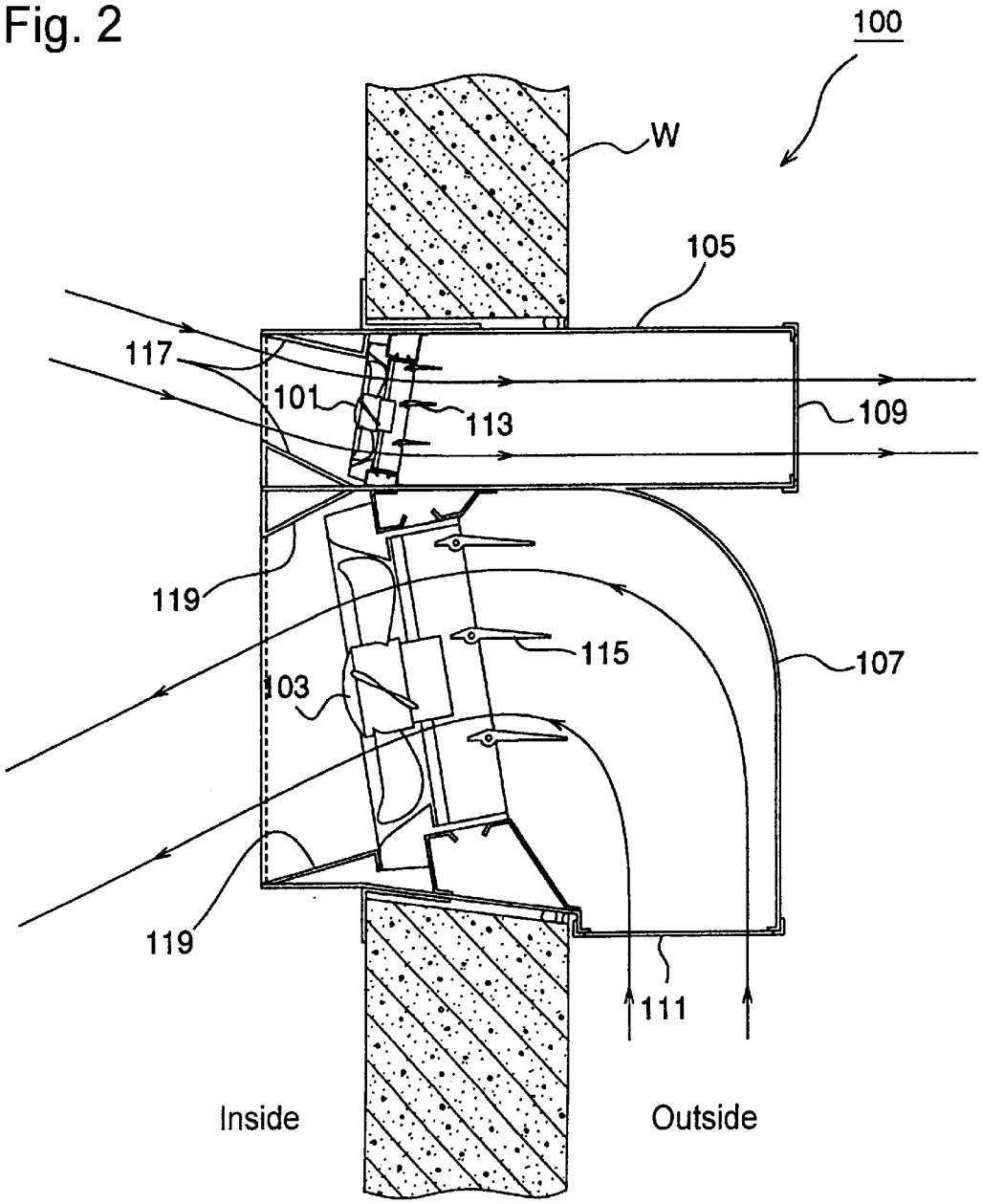
FIG. 2 is a cross sectional view of a ventilation device in which each of the fans is rotating in a direction opposite to that shown in FIG. 1.

FIG. 2 shows the case where the fans 101 and 103 are rotated in the directions opposite to the example of FIG. 1. Thus, the fan 103 intakes the outside air while the fan 101 exhausts the room air. Since the volume of the inhaled air is larger than that of the exhausted air, air is inhaled into the room on the whole. Since the air intake and air exhaust are conducted at the same time, the air resistance in the airtight room is decreased so that the airflow becomes smooth enough to achieve effective ventilation.

In addition, by arranging the fans 101 and 103 in the different directions such as the upward and downward directions, respectively, the exhausted air and inhaled air will not interfere with each other so that the efficiency of ventilation is improved. Further, by attaching the regulating plates 117 and 119 in the inclined manner to match the slant angle of the fans 101 and 103, the interference of air can be further prevented so that more efficient ventilation can be achieved.

In the above embodiment, although the fans 101 and 103 are fixed to separate fixing boards, they may be fixed to a common fixing board. Also, the size of the fans and/or the tubular bodies may be different from one another or identical to one another. Further, the fans and/or tubular bodies may be positioned in an up and down relationship or in a left and right relationship.

Figure 3:
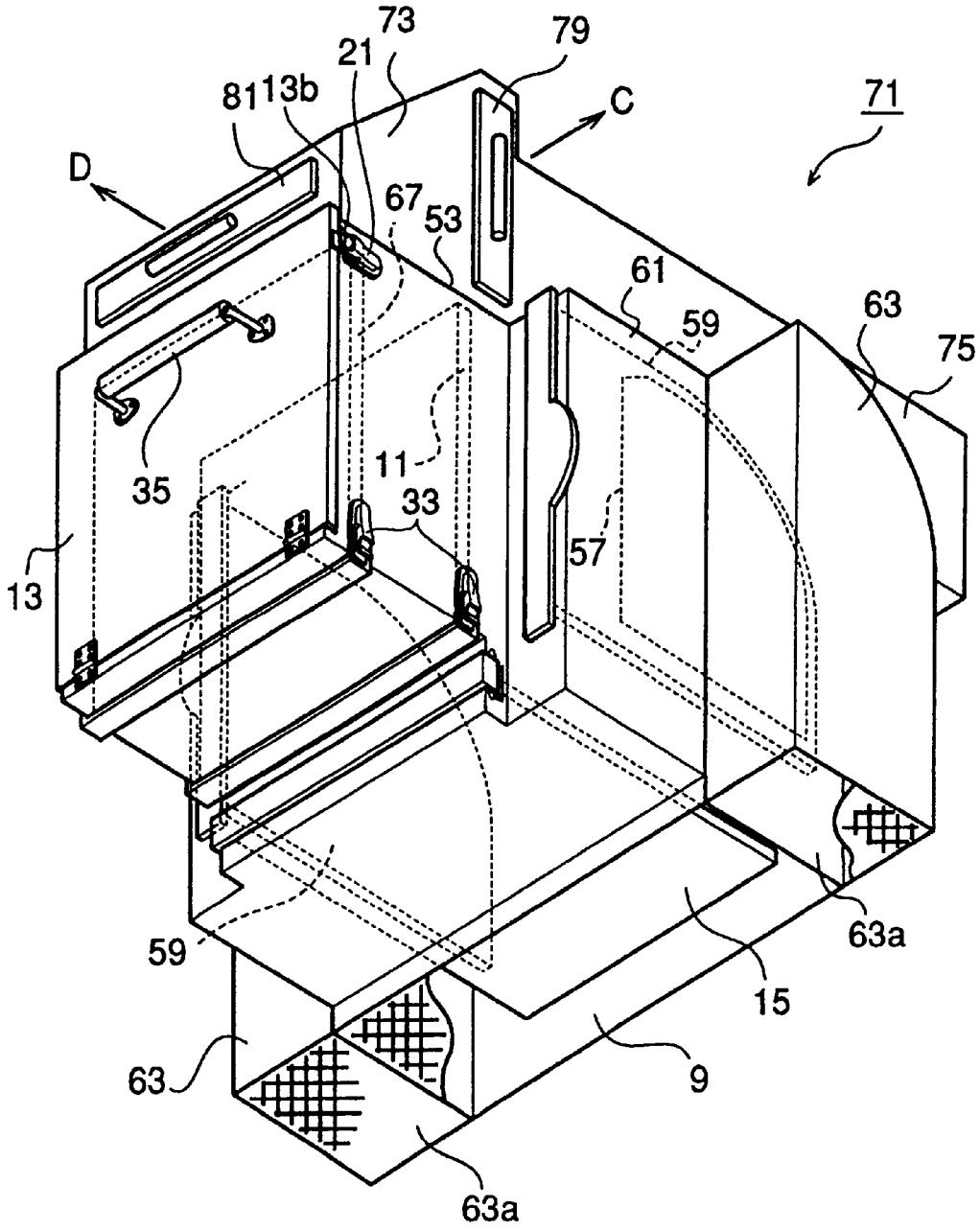
FIG. 3 is a perspective view showing the ventilation device having a plurality of fans in the second embodiment of the present invention.
Figure 4:
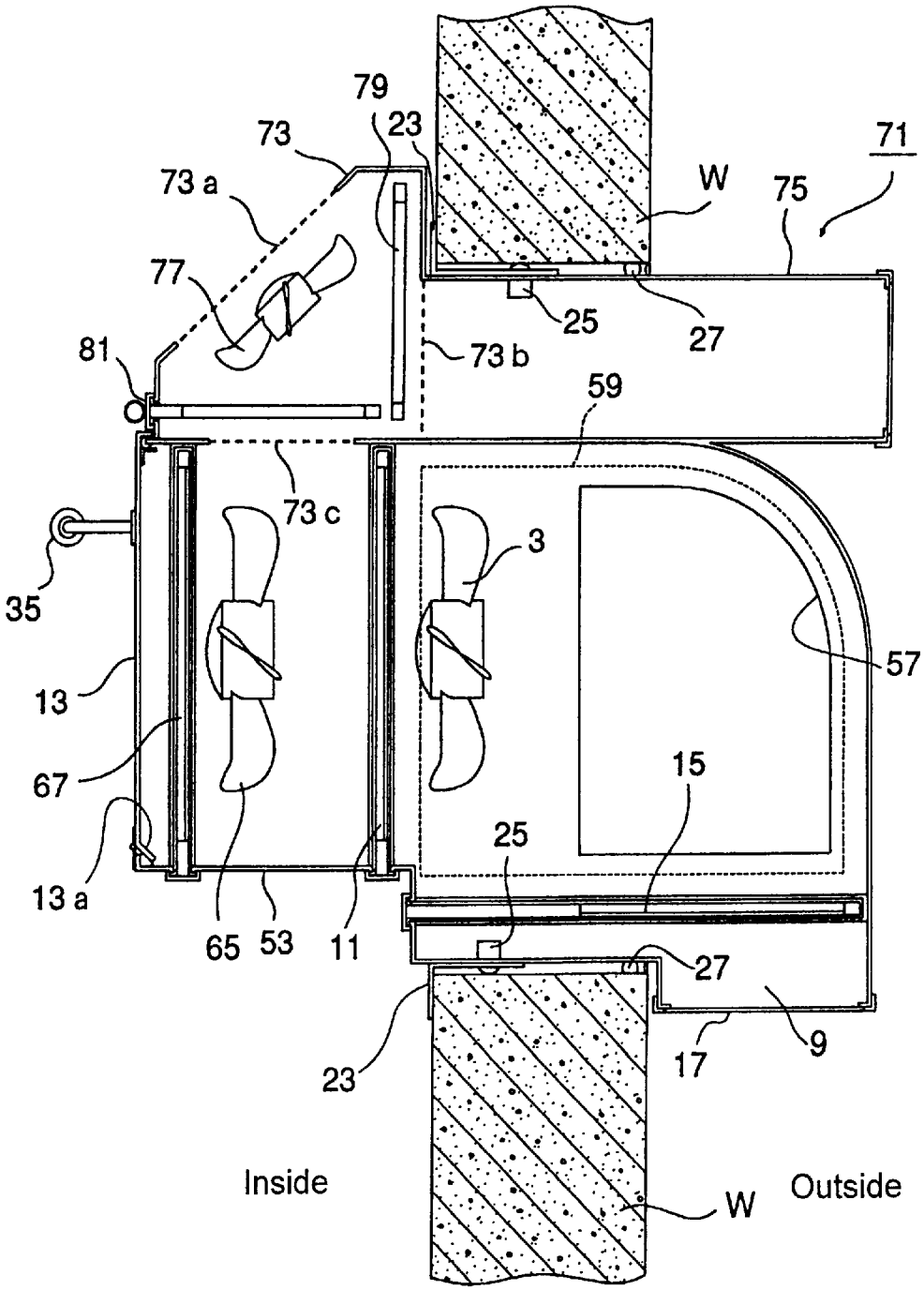
FIG. 4 is a cross sectional view of the ventilation device in the second embodiment of the present invention.

FIG. 3 is a perspective view of the ventilation device 71 in the second embodiment of the present invention. FIG. 4 is a cross sectional view of the ventilation device 71 which is attached to a concrete wall W.

As shown in FIGS. 3 and 4, the ventilation device 71 has an L shaped tubular body 53 made of metal for mounting fans 3 and 65 therein. The tubular body 53 is provided with an opening ("inside opening") at the inside of the wall W (left side of FIG. 4). The tubular body 53 is provided with an opening ("outside opening") 9 in a downward direction at the outside of the wall W (right side of FIG. 4).

A filter 11 is removably inserted in the inside opening of the tubular body 53 in a vertical direction. Toward the further left side from the filter 11, the fan 65 and the filter 67 are provided in that order. If necessary, additional fans or filters may be provided. A cover 13 is provided at the left end of the ventilation device to open or close the end. A knob 35 is provided to easily open or close the cover 13.

An intake filter 15 is removably inserted close to the outside opening 9 in a horizontal direction (right and left direction of FIG. 4). A metal net 17 is attached to the outside opening 9. The fans 3 and 65 can rotate either the backward or forward direction. At the time of air intake, intake filters 15 and 59 are installed in the ventilation device. At the time of air exhaust, exhaust filters 11 and 67 are installed in the ventilation device.

The cover 13 is rotatably attached to the tubular body 53 by a hinge. The cover 13 is provided with a water proof structure which can reliably shut off the rain/wind from the outside. Namely, a groove is created by double rising portions formed at the circumference of the cover 13. The groove is formed at three sides of square of the cover 13 except the bottom side thereof. A rubber packing is provided at the bottom of the groove. A bent portion 13*a* is formed at the bottom side of the cover 13. The bent portion 13*a* has an angle defined by this folded portion 13*a* and the cover 13 which is slightly larger than 90 degrees. A rubber packing is attached to the outer surface of the bent portion 13*a*. The more details of the cover structure is given in Japanese Patent No. 2,530,284 owned by the same inventor of the present invention.

By closing the cover 13, the ends of the upper plate and side plates of the tubular body 53 are fitted in the groove formed at the circumference of the cover 13 to tightly contact the rubber packing therein. On the other hand, the bent portion 13*a* of the cover 13 covers the connecting portion (such as hinges) which connects the cover 13 to the tubular body 53 and contacts the inside of the tubular body 53 through the rubber packing. Alternatively, the structure of the cover 13 may be more simplified in which no such a water proof structure is provided.

Metal fittings 13*b* are provided at the upper portions of the cover 13. Clamps 21 for fixing the metal fittings 13*b* are mounted on the tubular body 53. The cover 13 can be easily locked with use of the clamps 21.

As shown in FIG. 4, metal fittings 23 are fixed to the ventilation device 71 through bolts 25. The metal fittings 23 are attached to the wall W through fastening means such as bolts or anchor bolts so that the ventilation device 71 is installed on the wall W. A rubber packing 27 is provided between the tubular body 53 and the wall W.

Figure 5:
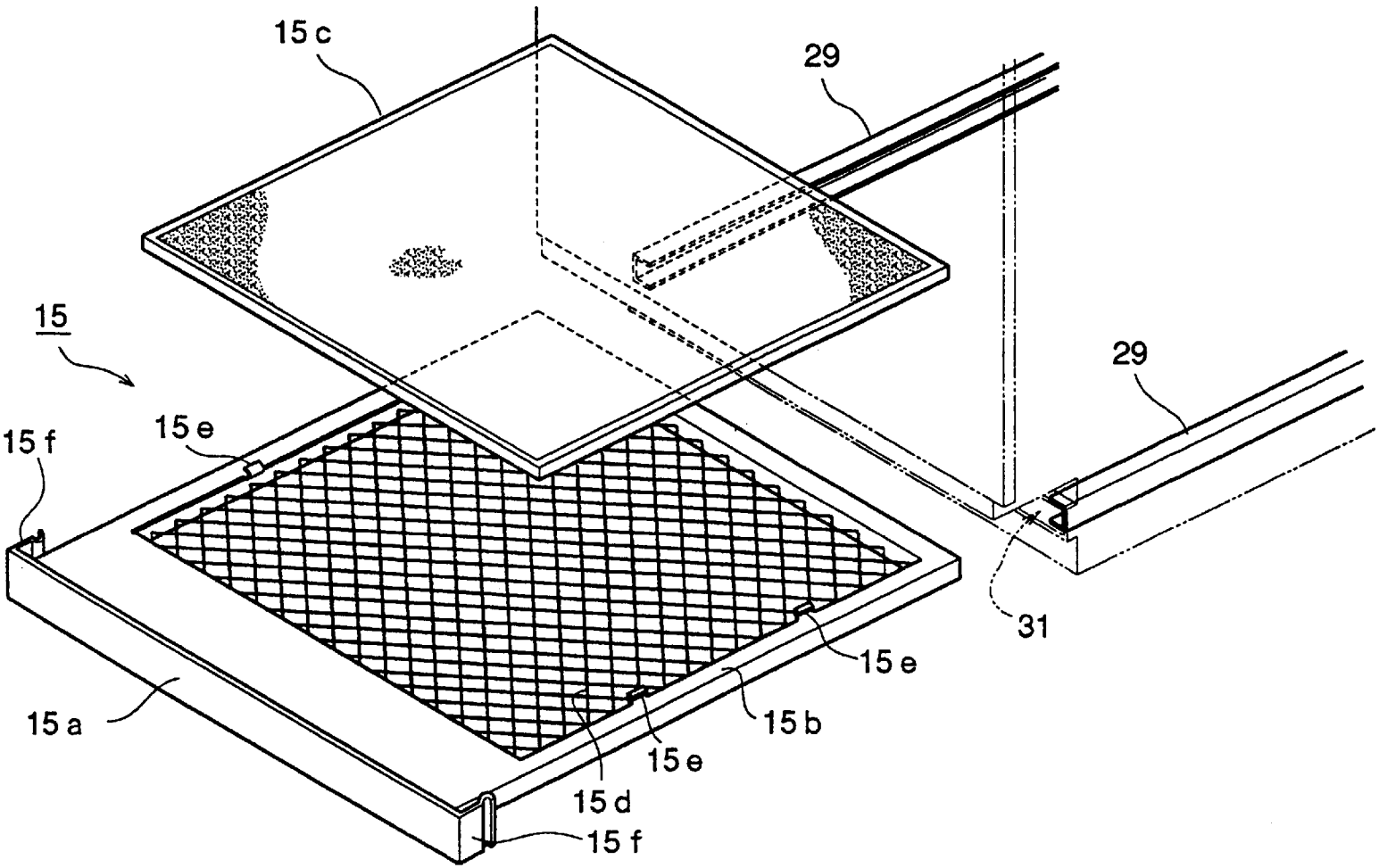
FIG. 5 is a perspective view of an example of air filter which is attached to the ventilation device of FIGS. 3 and 4.

FIG. 5 is a exploded view showing the details of the intake filter 15. The intake filter 15 is formed in a cassette type and has a handle 15*a*, a filter attachment frame 15*b* having an opening, a cassette type filter (filter member) 15*c* and a net 15*d* provided at the opening of the filter attachment frame 15*b*. Four filter press claws 15*e* are provided at the opening side of the filter attachment frame 15*b*. By fitting the cassette type filter 15*c* in the opening of the filter attachment frame 15*b*, the surface of the cassette type filter 15*c* is pressed by the claws 15*e* so that the filter 15*c* is firmly attached to the opening.

It should be noted that FIG. 5 merely shows an example of fixing the cassette filter. The fixing method and structure is not limited to the one described above, but various other ways of fixing can be feasible. For example, the filter attachment frame 15*b* may be provided with a groove instead of the press claws 15*e* such that the filter member 15*c* is fitted into the groove. Also, the filter member 15*c* may be fixed to the attachment frame 15*b* by using metal fittings. In short, the fixing structure and method of the filter member 15*c* can be determined depending on such factors as strength of ventilation airflow, cost, and the like.

The filter member 15*c* may be changed depending on the purpose of using the filter, such as clearing dust, cleaning air pollutants or shutting off poisonous gas and the like. Thus, the kinds of the filter to be used can be determined depending on the environment where the ventilation device 71 is used.

As shown in FIG. 5, the filter attachment frame 15*b* is inserted in a U-shaped frame receptacle 29 provided at the lower position of the tubular body 53. If the filter 15 is completely inserted in the frame receptacle 29 by pushing the filter in a horizontal direction, a pressing springs 15*f* provided at both ends of the knob 15*a* are fitted in receiving portions (not shown) provided at the side plates of the tubular body 53 so that the filter 15 is fixed therein. An insertion hole 31 of the filter attachment frame 15*b* is positioned inside of the wall W (room).

The configuration of the exhaust filters 11 and 67 is basically the same as that of the intake filter 15. Small differences may exist in that hooks are provided on the knobs of the exhaust filters 11 and 67, and metal clamps 33 are provided on the side faces of the tubular body 53 (FIG. 3). The hooks are clamped by the metal clamp 33 to firmly attach the filters 11 and 67 to the tubular body 53.

Side openings 57 are provided at one or both sides of the tubular body 53 at the outside of the wall W to ensure a sufficient overall size of intake and exhaust area, thereby deceasing the airflow resistance. Further, cleaning ability of the ventilation device can be enhanced by providing filters at the side openings 57. For doing this, at both sides of the tubular body 53, corresponding to the side openings 57, filters 59 are slidably attached to filter holders 61.

Outer sides of the side openings 57 are covered by hoods 63 as shown in FIG. 3. The hoods 63 are fixed to the tubular body 53 by welding or screwing. The hoods 63 are provided with openings 63*a* at the bottom of the ventilation device 71, thereby preventing rains/winds from directly entering the tubular body 53 through the side openings 57. Consequently, the air in the building is exhausted in a downward direction through the openings 57 and the hood 63. The outside air is introduced into the building through the openings 63*a* and the side openings 57.

The structure of the filter 59 is basically the same as that shown in FIG. 5. Namely, the filter 59 is formed as a cassette type in which a filter member is replaceably fixed to a filter attachment frame. Kinds of filter may be selected depending on the purpose of the ventilation device. The filter member is attached to the position where it can cover the side corresponding opening 57. The filter 59 is inserted in a filter holder 61 and locked therein by a press spring such as shown in FIG. 5.

The ventilation device 71 of FIGS. 3 and 4 is further provided with a fan compartment 73 and a duct 75. The duct 75 is to establish an air path between the fan compartment 73 and the outside of the wall W, i.e., inside and outside of the room. A fan 77 (the second fan) is installed in the fan compartment 73 in an inclined manner as shown in FIG. 4. A multi-blade fan may be used for the fan 77 as well as the fans 3 and 65. An end opening 73*a* is provided in front of the fan 77. An air passage between the fan compartment 73 and the duct 75 is established through a first air hole 73*b*. An air passage between the fan compartment 73 and the tubular body 53 having the fan 65 therein is established through a second air hole 73*c*.

An inserting plate 79 is inserted in front of the first air hole 73*b*. The inserting plate 79 is pressed in or pulled out in the right left direction of the ventilation device 71 (direction shown by an arrow C in FIG. 3). An inserting plate 81 is inserted in front of the second air hole 73*c*. The inserting plate 81 is pressed in or pulled out in the forward and backward direction of the ventilation device 71 (direction shown by an arrow D in FIG. 3). Although not illustrated in FIGS. 3 and 4, the inserting plates 79 and 81 are slidably held in corresponding holders.

Figure 6A:
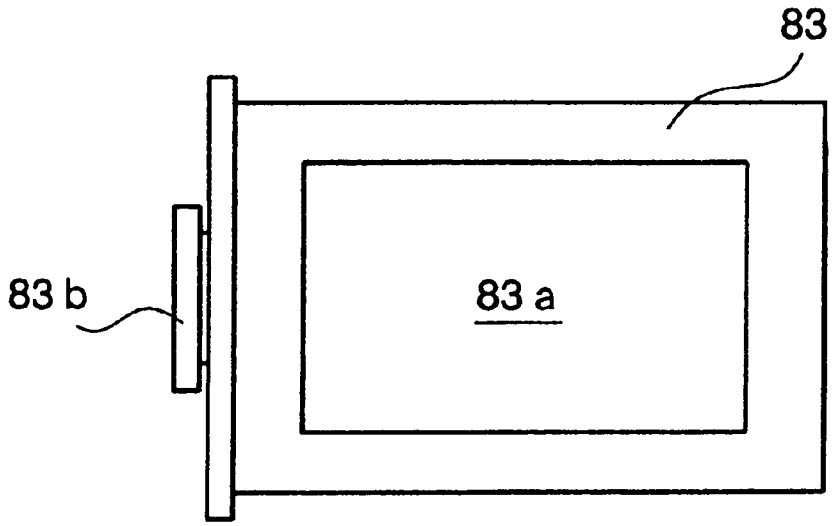
FIGS. 6A and 6B are top views of inserting plates, one having an air opening and the other without having the opening, respectively, to be inserted in the ventilation device of the present invention.
Figure 6B:
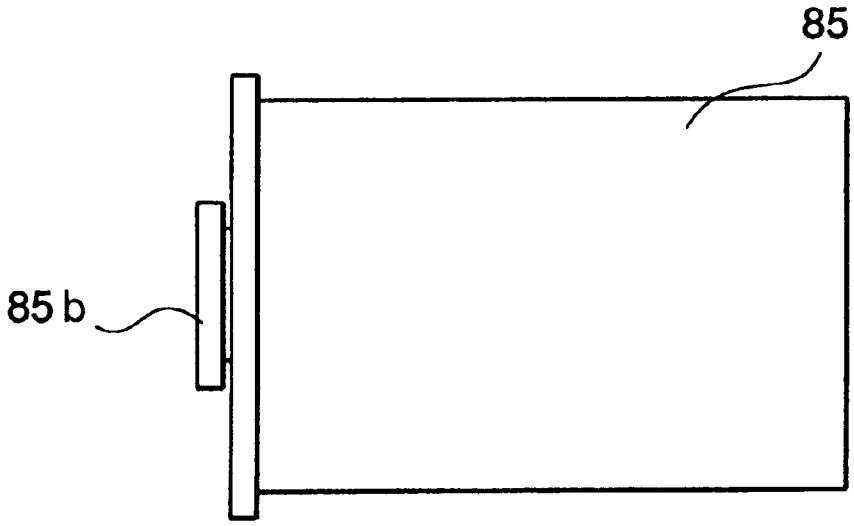

FIGS. 6A and 6B show more details of the inserting plates 79 and 81. There are two kinds of inserting plates which are denoted by reference numerals 83 and 85 in FIGS. 6A and 6B, respectively. The inserting plate 83 (opening plate) of FIG. 6A is provided with an opening 83a while the inserting board 85 (closing plate) of FIG. 6B is not provided with an opening. Knobs 83*b* and 85*b* are provided on the inserting plates 83 and 85, respectively, for a handling purpose. The operation of the ventilation device 71 varies depending on which one of the inserting plates 83 and 85 is used at the first air hole 73*b* or the second air hole 73*c* of the fan compartment 73.

Figure 7:
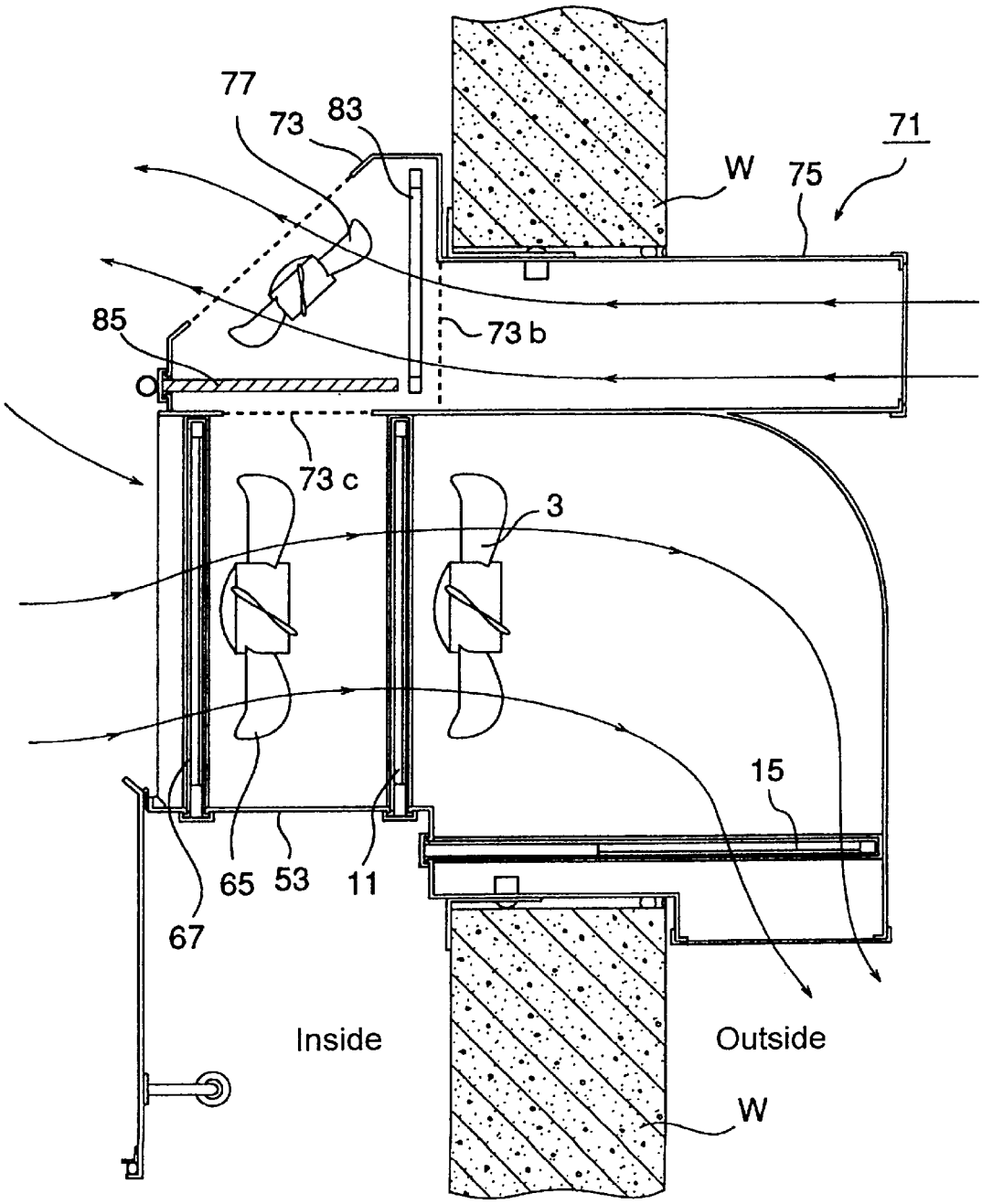
FIG. 7 is a cross sectional view showing an example of operation of the ventilation device in the second embodiment of the present invention.

The operation of the ventilation device 71 is explained with reference to FIGS. 7–12. As shown in FIG. 7, the second air hole 73*c* of the fan compartment 73 is closed by the inserting (closing) plate 85, and the inserting (opening) plate 83 is provided at the first air hole 73*b*. The exhaust filters 11 and 67 are inserted in the ventilation device and fixed by the metal clamp 33. The filter members for the filters 15 and 59 (FIGS. 3 and 4) are removed, leaving only the filter attachment frame 15*b* (FIG. 5) in the frame receiver. Under this arrangement, the fans 3 and 65 are rotated in the exhaust direction and the fan 77 is rotated in the intake direction.

By the rotation of the fans 3 and 65 under this condition, the air inside the room is exhausted toward the outside through the filters 67 and 11 and outside openings 9 and 63*a* (shown in FIG. 3). Accordingly, the flow of the exhaust air is enhanced, and accumulation of dust in the groove of the frame receiver 29 is prevented. Filter members for the filters 67 and 11 may be replaced depending on the purpose of using the ventilation device.

On the other hand, the outside air is introduced into the room through the duct 75 and the opening plate 83 by the fan 77. Thus, the intake air flows in a manner shown in the upper part of FIG. 7. Since the flows of intake air and exhaust air are taken place at the same time without interfering with each other, the air resistance is reduced and smooth ventilation can be achieved.

Figure 8:
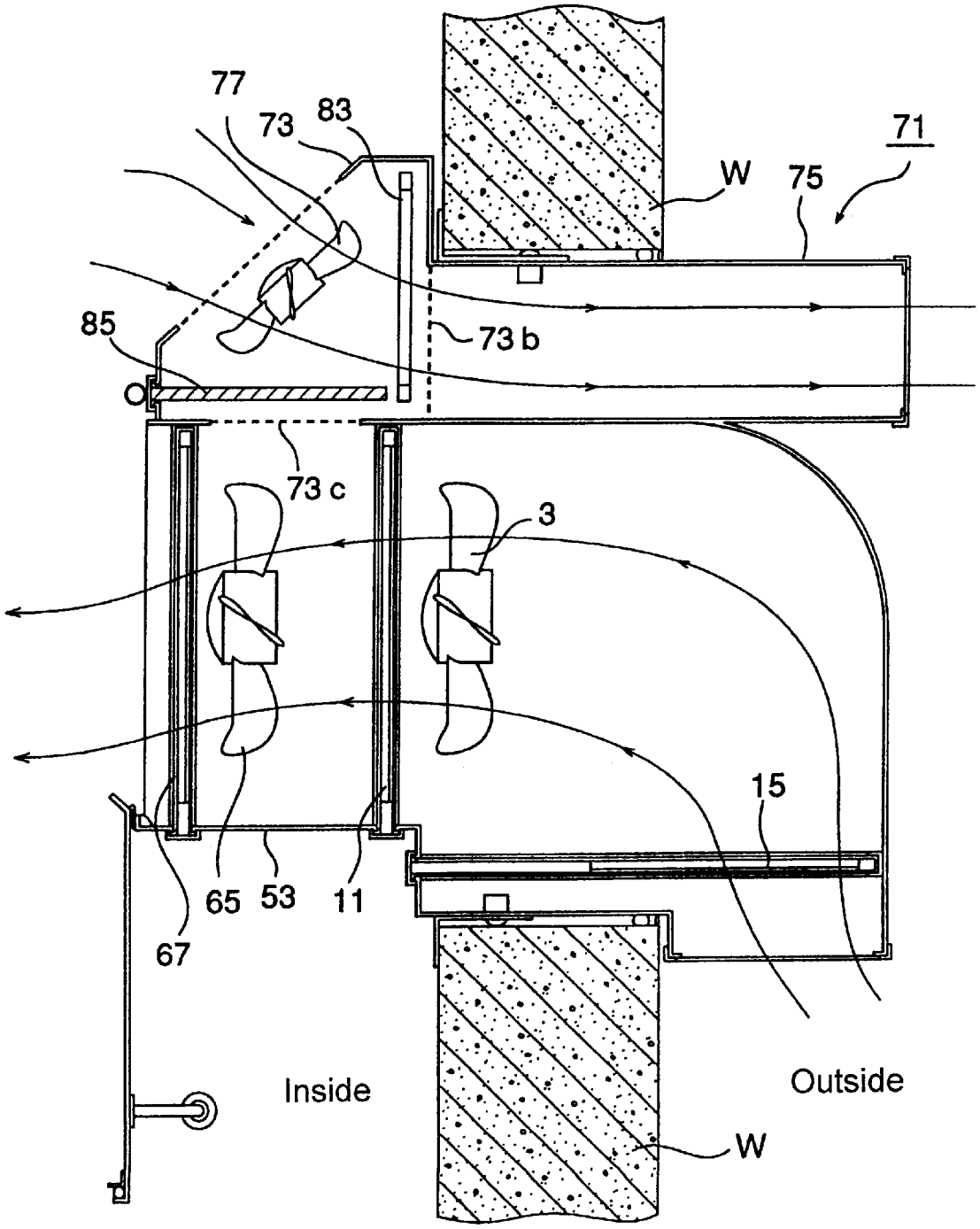
FIG. 8 is a cross sectional view showing another example of operation of the ventilation device in the second embodiment of the present invention.

In FIG. 8, the direction of rotations of the fans are reversed from the situation shown in FIG. 7. The air intake is performed in the tubular body 53 by the fans 3 and 65, and the air exhaust is performed through the duct 75 by the fan 77. Here, the filters 15 and 59 as shown in FIGS. 4 and 5 are inserted in the ventilation device while the filter members of the filters 67 and 11 are removed, leaving only the filter attachment frames 15*b* (FIG. 5) therein.

As explained above, by using the above ventilation device 71, in FIG. 7, the outside air is introduced through the duct 75 by the rotation of the fan 77 while the inside air is expelled through the tubular body 53 by the rotation of the fans 3 and 65. In contrast, in FIG. 8, the inside air is expelled through the duct 75 by the rotation of the fan 77 while the outside air is introduced through the tubular body 53 by the rotation of the fans 3 and 65. In either case, since the air intake and the air exhaust are performed at the same time, the air resistance is reduced, thereby achieving smooth ventilation.

Figure 9:
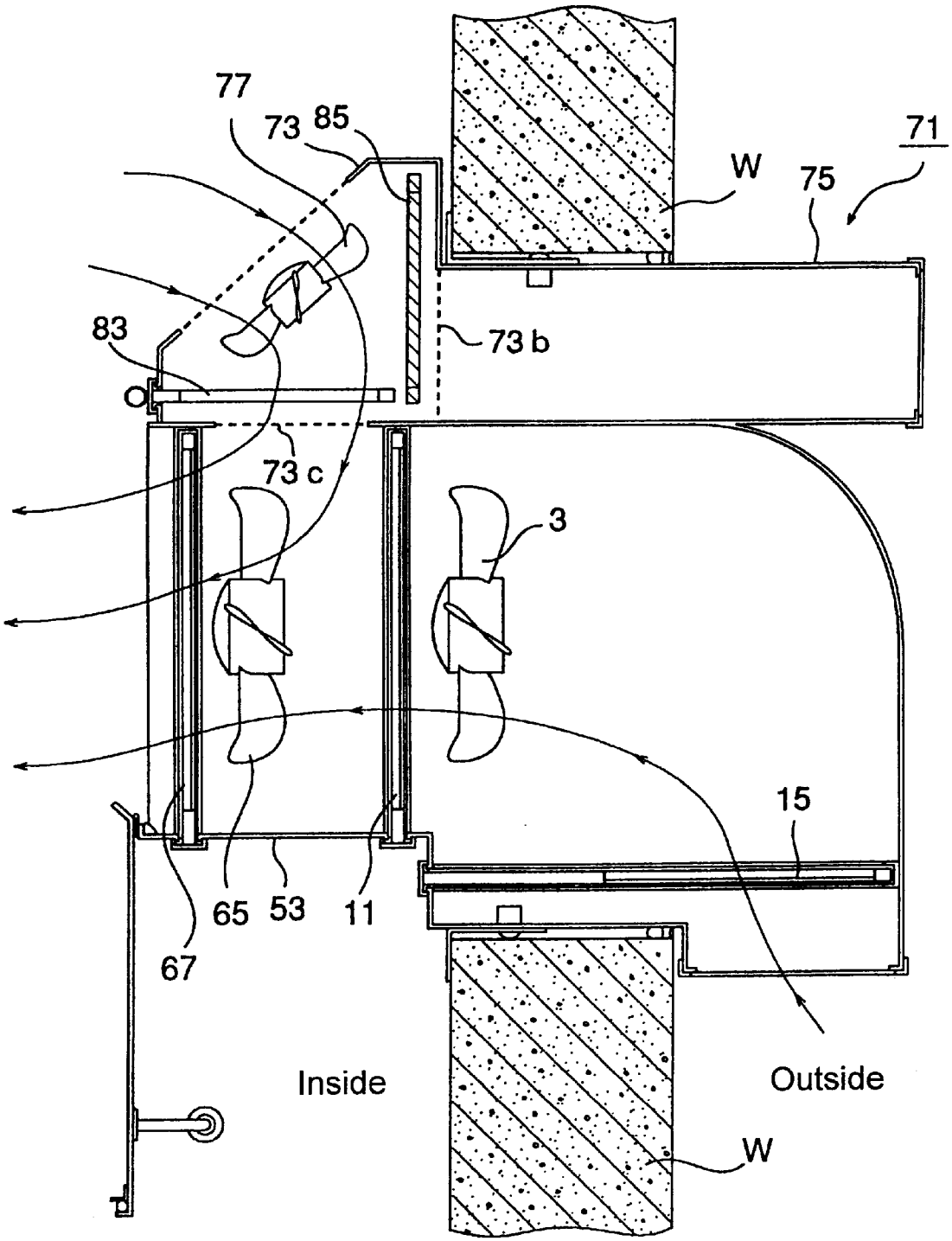
FIG. 9 is a cross sectional view showing a further example of operation of the ventilation device in the second embodiment of the present invention.

Further, in the example of FIG. 9, the opening plate 83 is provided at the second air hole 73*c* in the fan compartment 73. Also in the fan compartment 73, the first air hole 73*b* is closed by the closing plate 85. The fans 3 and 65 are rotated in the direction for inhaling the outside air while the fan 77 is rotated in the direction for exhausting the inside air. Thus, air flows as shown in FIG. 9 are established by the rotations of the fans.

The air in the room is attracted by the fan 77 and thereafter introduced into the tubular body 53 through the second air hole 73*c*. The introduced air is then sent back to the room through the filter 67, and thereby the polluted air in the room is cleaned by the filter 67. The outside air is also introduced in the room through the tubular body 53 via the filters 11 and 67. Namely, in the arrangement of FIG. 9, the ventilation device of the present invention functions as an air cleaner.

Figure 10:
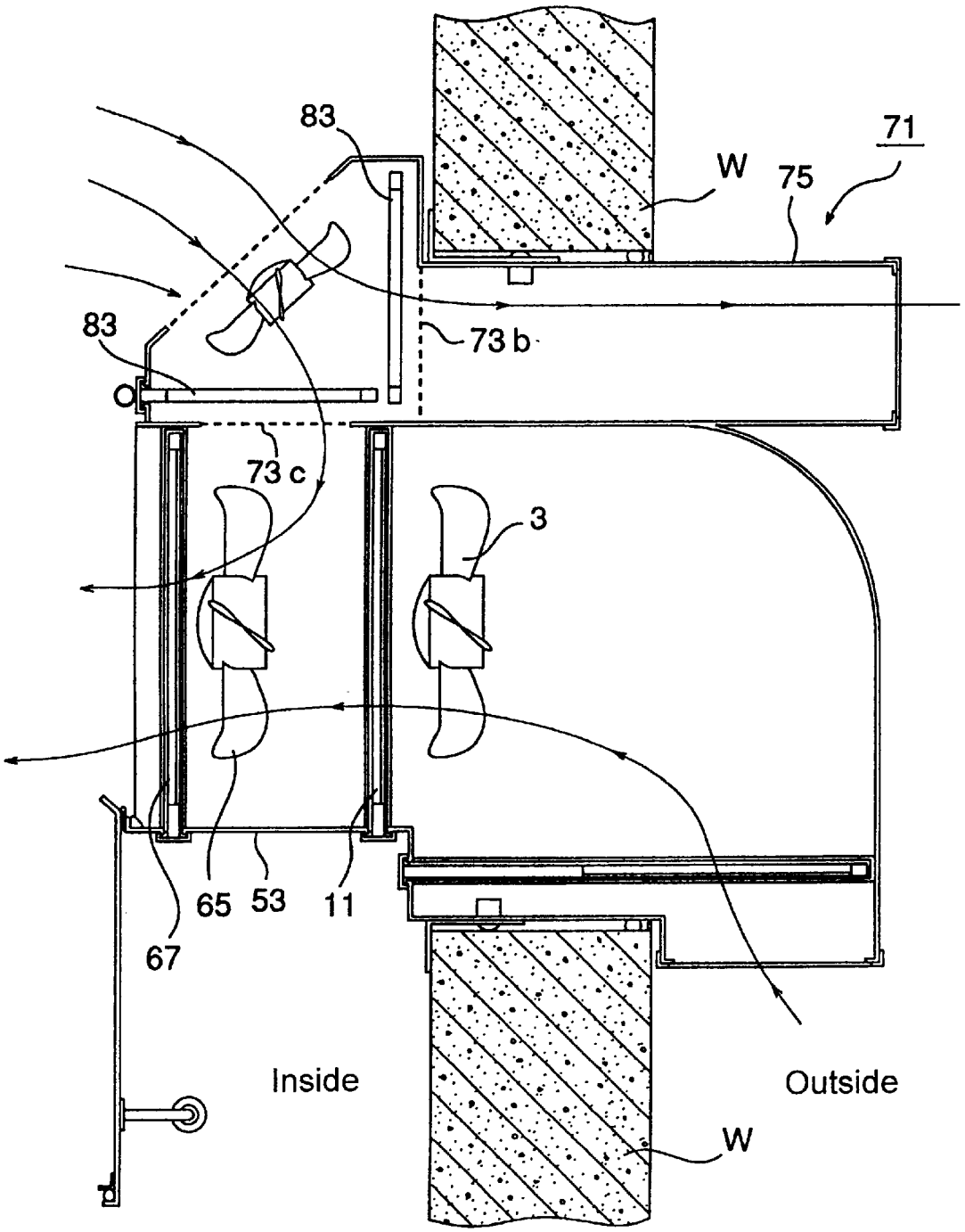
FIG. 10 is a cross sectional view showing a further example of operation of the ventilation device in the second embodiment of the present invention.

FIG. 10 shows the case in which the opening plates 83 are provided at both the first air hole 73*b* and the second air hole 73*c*. In this situation, part of the polluted air in the room is exhausted to the outside through the duct 75 while the other part of the inside air is returned to the room through the filter 67. Compared with the example of FIG. 9, the example of FIG. 10 includes the outgoing air flow through the duct 75, resulting in reduction of the air resistance in the ventilation device.

Figure 11:
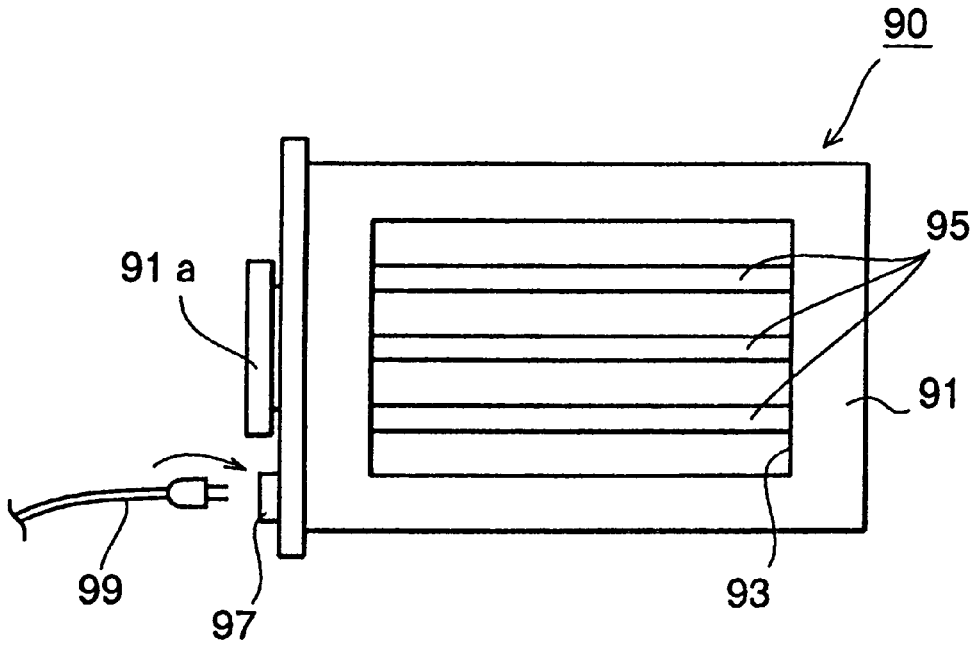
FIG. 11 is a front view showing an example of a heater to be attached to the ventilation device.

FIG. 11 shows an example of heater (detachable heater) 90 which can be inserted in the ventilation device 71 instead of the filter 11 or 67. The heater 90 is formed of a plurality of heater elements 95 provided in an opening 93 of a flat board 91. A knob 91*a* is attached to the flat board 91. Electric power is supplied from an electric power source cord 99 to the heater elements 95 through a socket 97.

Figure 12A:
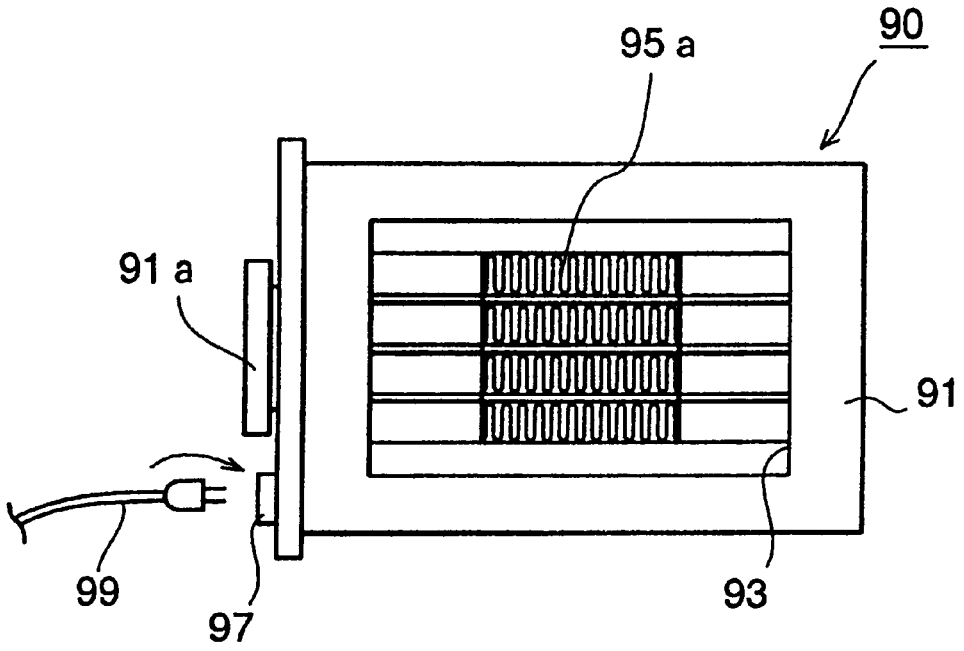
FIG. 12A is a front view showing another example of the heater to be attached to the ventilation device.
Figure 12B:
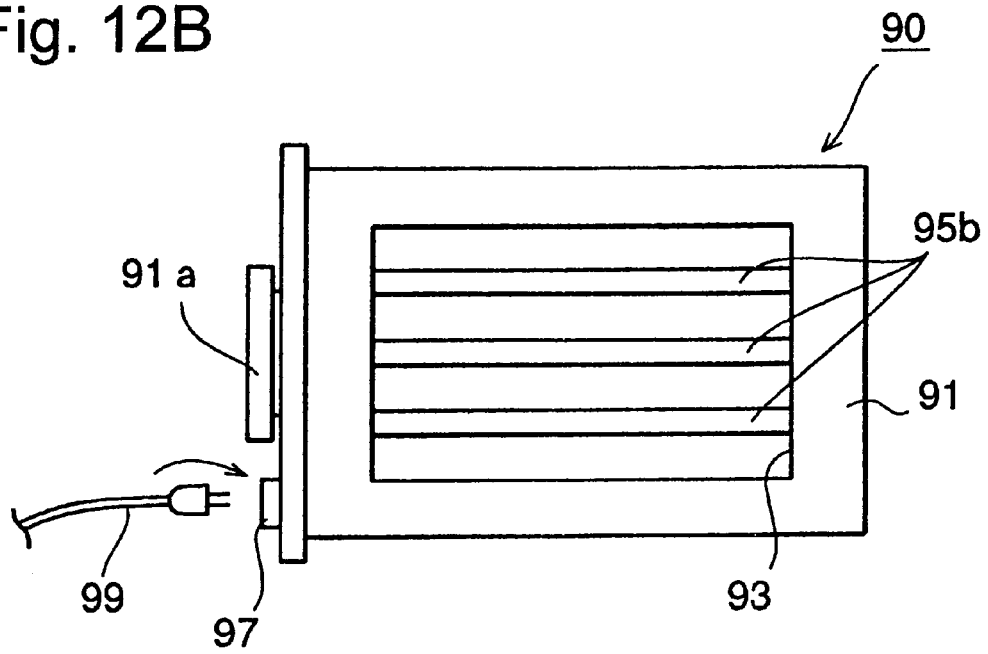
FIG. 12B is a front view showing a further example of the heater to be attached to the ventilation device.
Figure 13A:
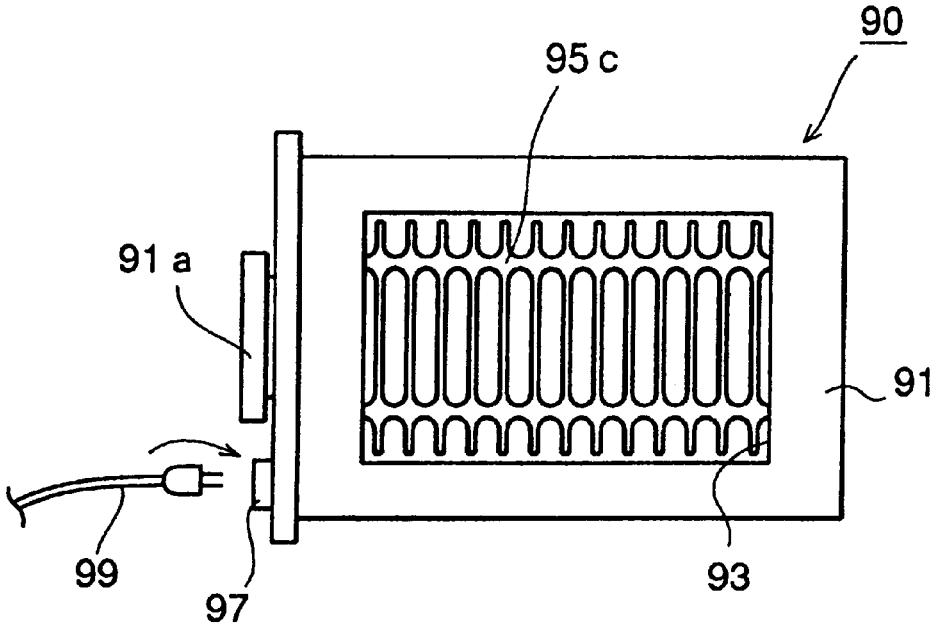
FIG. 13A is a front view showing a further example of the heater to be attached to the ventilation device.
Figure 13B:
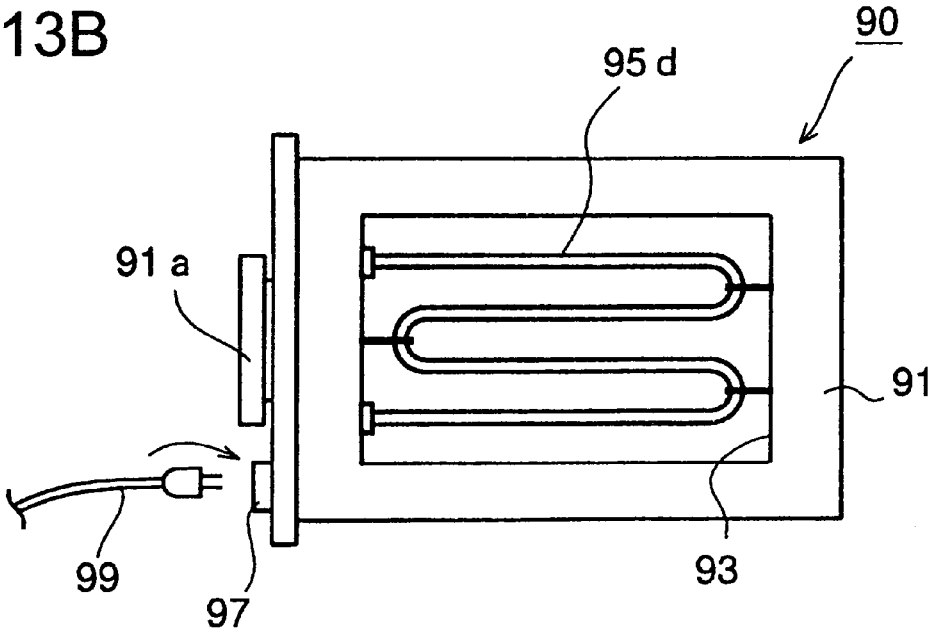
FIG. 13B is a front view showing a further example of the heater to be attached to the ventilation device.

Various types of heater elements can be used in the heater 90. FIGS. 12A–12B and FIGS. 13A–13B show examples of heaters using various kinds of heater elements. FIG. 12A shows a heater having ceramic heater elements 95*a* therein. FIG. 12B shows a heater having therein quarts pipe heater elements (infrared rays heater) 95*b*. FIG. 13A shows a heater having heater elements 95*c* of an oil sealed radiator type therein. FIG. 13B shows a heater using far infrared rays heater elements 95*d*.

Figure 14:
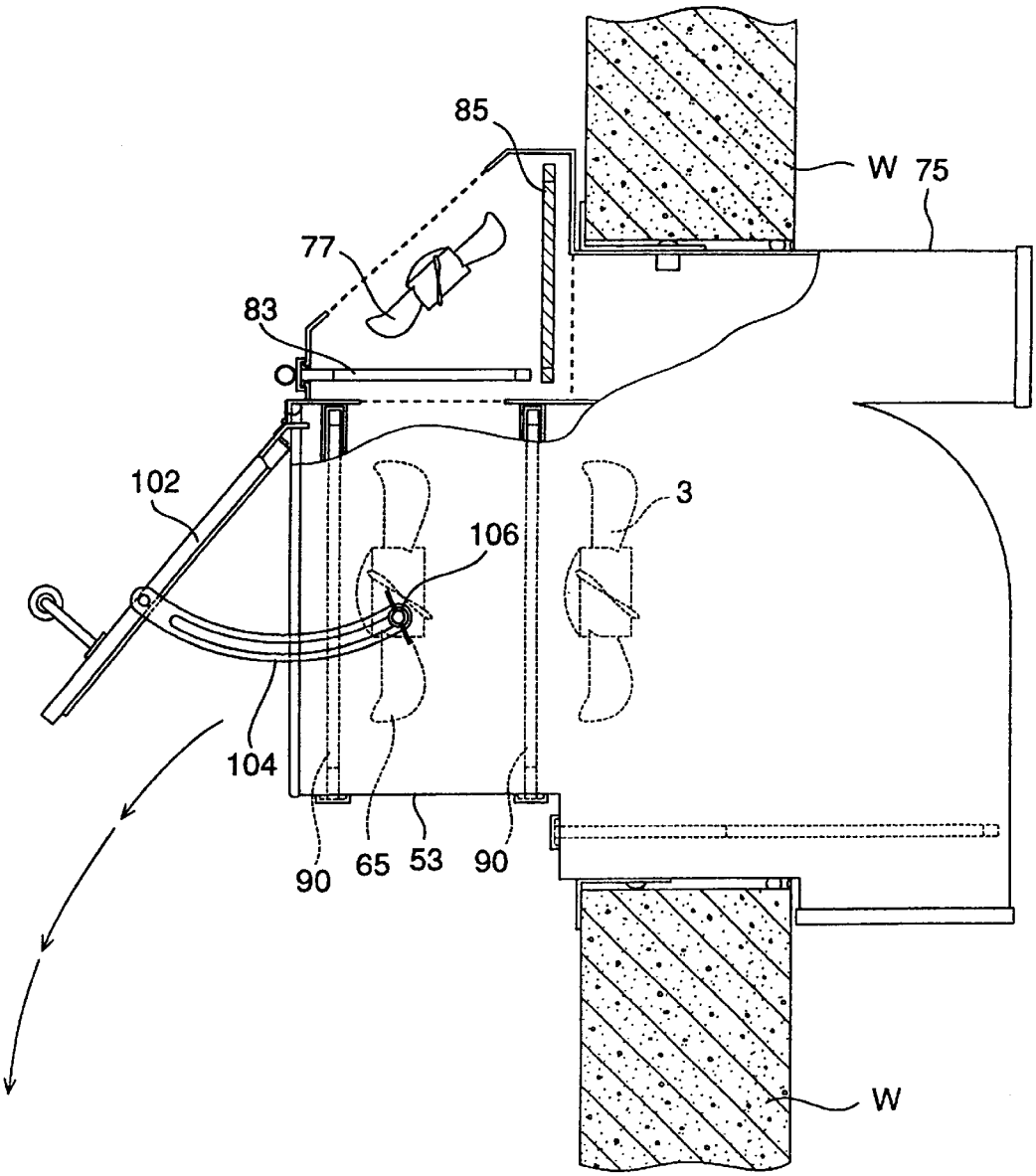
FIG. 14 is a cross sectional view showing an example of structure for attaching the cover in the ventilation device of the present invention.

By inserting the above described heater 90, instead of the filters 11 or 67, the ventilation device of the present invention can be used as a heating apparatus or an air conditioner. In this case, a cover 102 which can open and close about an axis on the top thereof as shown in FIG. 14 may be employed in combination with the heating apparatus. The cover 102 is provided with a bracket 104 having a slit to adjust the opening angle of the cover 102. The bracket 104 can be fixed within the length of the slit by a thumbscrew 106 provided on the tubular body 53.

By the arrangement of FIG. 14, the heated air is prevented from going upward but is blown downward so that the heating effect is enhanced. In other words, the cover 102 functions as an air guide for the heater. By adjusting the position where the bracket 104 is screwed by the thumbscrew 106, the opening angle of the cover 102 can be adjusted. The direction of the blowing of the heated air can be varied in accordance with the opening angle of the cover 102. A thermal insulating sheet or a thermal insulating board may be attached inside the cover 102. Likewise, thermal insulating material may be provided inside the tubular body 53 depending on the use thereof.

By changing the combination of the inserting positions of the filters 11 and 67 (FIG. 10), the opening plate 83, the closing plate 85, and the inserting position of the heater 90, the functions of the ventilation device of the present invention can be set in a variety of ways. Thus, the ventilation device of the present invention can be used for various purposes, such as ventilation, air cleaning, room heating and the like.

Figure 15:
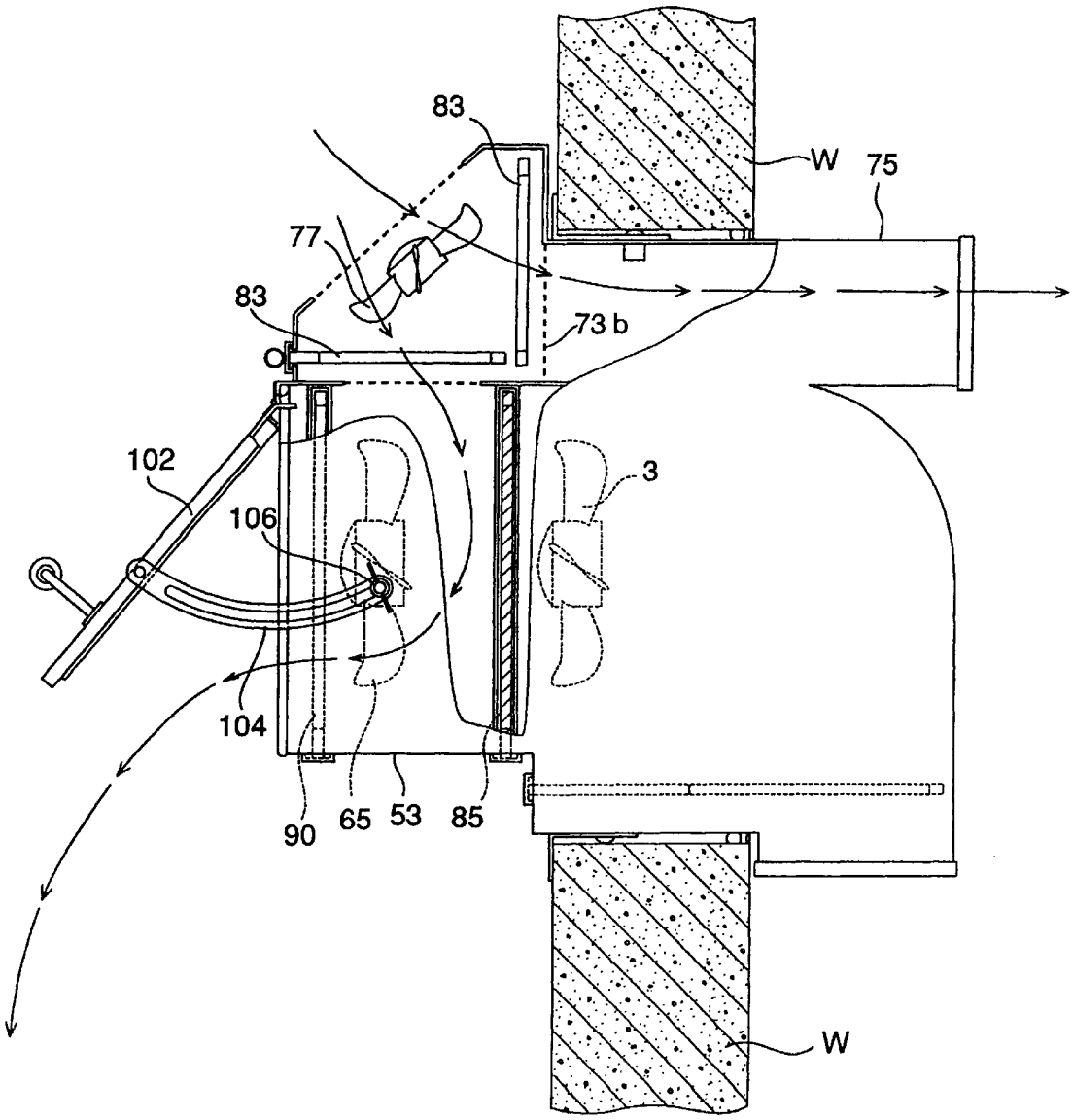
FIG. 15 is a cross sectional view showing another example of structure for attaching the cover in the ventilation device of the present invention.

FIG. 15 shows one of such combinations in which the opening plate 83 is provided at the first air hole 73*b*, the filter 11 is replaced with the closing plate 85, and the heater 90 is provided instead of the filter 67. By this arrangement, the air inside the room is attracted by the fan 77 and is partially exhausted to the outside through the duct 75 and the remaining air is sent back to the inside of the room by the fan 65. Thus, the part of the room air is expelled while the other part of air circulates via the ventilation device. In the course of the air circulation, the air is heated by the heater 90. Namely, the ventilation device in this example is used as a heating apparatus.

Figure 16:
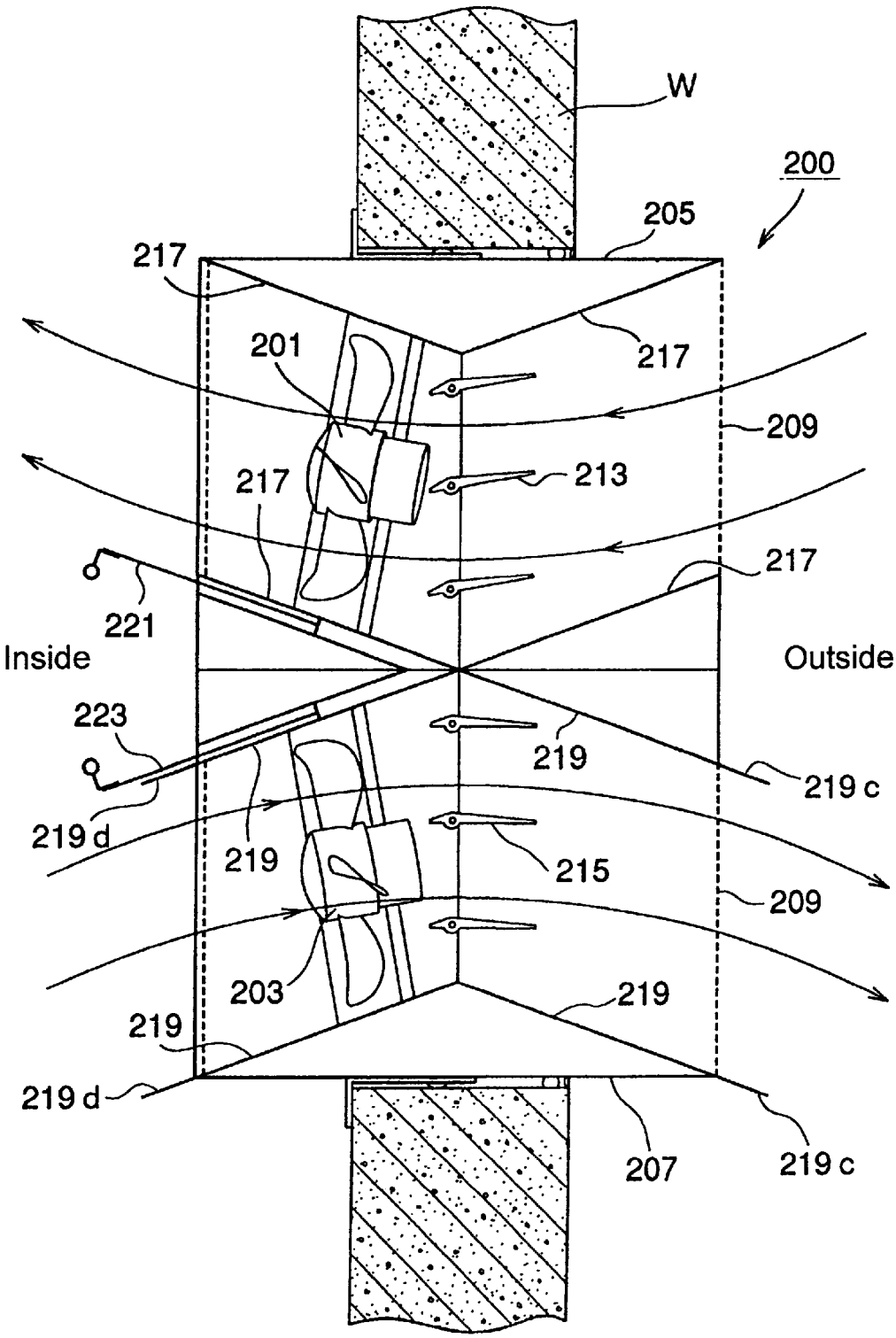
FIG. 16 is a perspective view showing the ventilation device having a plurality of fans in a third embodiment of the present invention.

FIG. 16 is a cross sectional view showing an example of ventilation device in the third embodiment of the present invention. A ventilation device 200 of FIG. 16 includes a fans 201 and 203. The fan 201 is installed in a tubular body 205 and the fan 203 is installed in a tubular body 207, respectively. The size of the fan 201 is about the same as that of the fan 203, and the size of the tubular body 205 is about the same as that of the tubular body 207. The cross section of the tubular bodies 205 and 207 has, for example, a square shape. Both ends of each of the tubular bodies 205 and 207 are opened in the horizontal direction. The end opening in the inside (left side of the drawings) of the wall W will be referred to as "inside opening" and the end opening in the outside (right side of the drawings) will be referred to as "outside opening". A net 209 is provided at each of the outside openings.

As shown in FIG. 16, the fan 201 is inclined slightly upwardly relative to the horizontal line while the 203 is inclined slightly downwardly relative to the horizontal line. The fans 201 and 203 are provided with shutters 213 and 215, respectively. Regulating plates 217 are provided at the inside (left side) of the tubular body 205 in an upwardly inclined direction to match the angle (orientation) of the fan 201. Regulating plates 219 are provided at the inside (left side) of the tubular body 207 in a downwardly inclined direction to match the orientation angle of the fan 203.

Regulating plates 217 are also provided at the outside (right side) of tubular body 205 in an upwardly inclined direction relative to the horizontal line. Thus, both the inside opening and the outside opening of the tubular body 205 are oriented in the upward directions opposite to one another. Similarly, regulating plates 219 are also provided at the outside (right side) of tubular body 205 in a downwardly inclined direction relative to the horizontal line. Thus, both the inside opening and the outside opening of the tubular body 207 are oriented in the downward directions opposite to one another.

The regulating plates 219 at the tubular body 207 are provided with projections 219*c* which extends from the outside opening. Similarly, the regulating plates 219 are provided with projections 219*d* which extends from the inside opening. Namely, the ventilation device of FIG. 16 includes the regulating plates which are limited within the tubular body 205 and the regulating plates which extend beyond the tubular body 207.

An extending plate 221 is attached to the regulating plate 217 at the inside opening of the tubular body 205 such that the extending plate can be freely extensible along the same direction of the regulating plate 217. Similarly, an extending plate 223 is attached to the regulating plate 219 at the inside opening of the tubular body 207 such that the extending plate 223 can be freely extensible along the same direction of the regulating plate 219.

Figure 17:
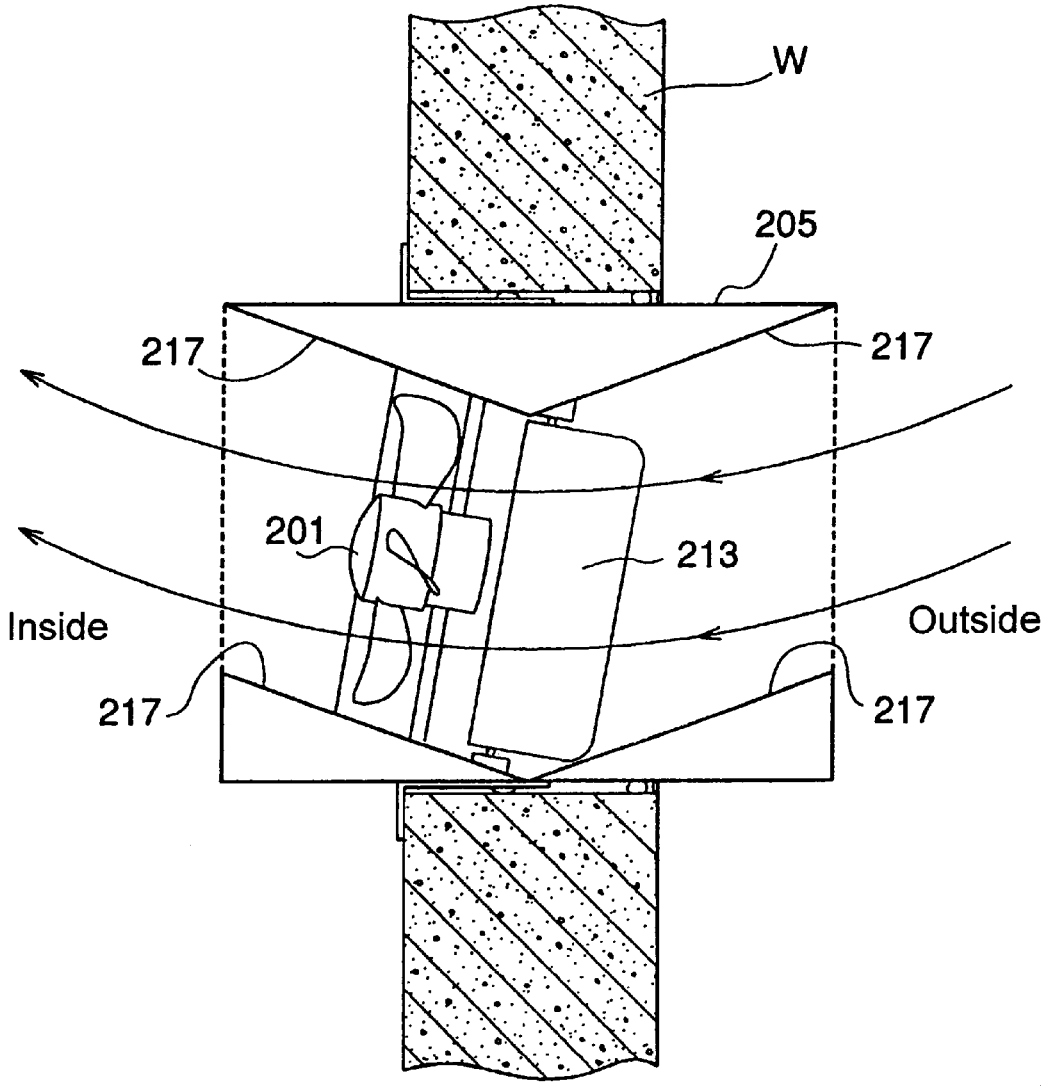
FIG. 17 is a cross sectional top view of the ventilation device showing the upper fan of the ventilation device shown in FIG. 16.

FIG. 17 is a cross sectional top view of the tubular body 205. As can be seen in FIG. 17, the fan 201 is inclined slightly backwardly. This means that the fan 201 is inclined not only in the upward direction as shown in FIG. 16, but also in the backward direction as shown in FIG. 17. Further, regulating plates 217 are oriented in backward direction to match the direction of the fan 201. Thus, it should be noted that the regulating plates 217 in FIG. 16 are top and bottom plates, while the regulating plates 217 in FIG. 17 are front and rear plates. The regulating plates (front and rear) 217 of FIG. 17 at the inside and outside openings are oriented in the backward direction.

Figure 18:
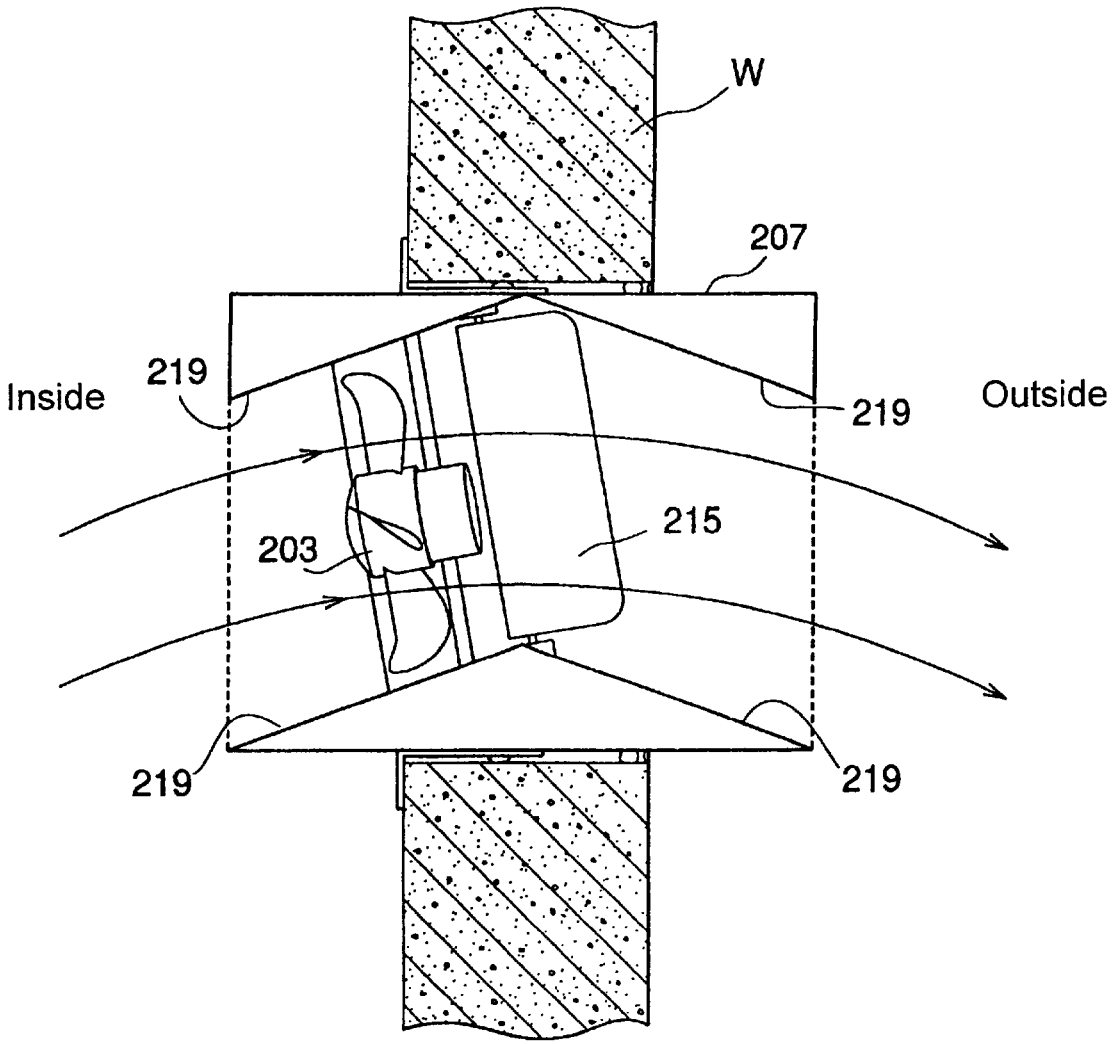
FIG. 18 is a cross sectional top view of the ventilation device showing the lower fan of the ventilation device shown in FIG. 16.

FIG. 18 is a cross sectional top view of the tubular body 207. As can be seen in FIG. 18, the fan 203 is inclined slightly forwardly. This means that the fan 203 is inclined not only in the downward direction as shown in FIG. 16, but also in the forward direction as shown in FIG. 18. Further, regulating plates 219 are oriented in forward direction to match the direction of the fan 203. It should be noted that the regulating plates 219 in FIG. 16 are top and bottom plates, while the regulating plates 219 in FIG. 18 are front and rear plates. The regulating plates (front and rear) 219 of FIG. 18 at the inside and outside openings are oriented in the forward direction.

According to the foregoing structure of the ventilation device 200, by the arranging the regulating plates 217 and 219 in the upward and downward directions as well as forward and backward directions, the air flow by the fan 201 and the air flow by the fan 203 can be regulated such that both air flows do not interfere with each other. Thus the ventilation can be conducted with less air resistance, thereby increasing ventilation efficiency. Further, by adjusting the length of the extending plates 221 and 223 (FIG. 16), the ventilation effect can be further improved.

Figure 19:
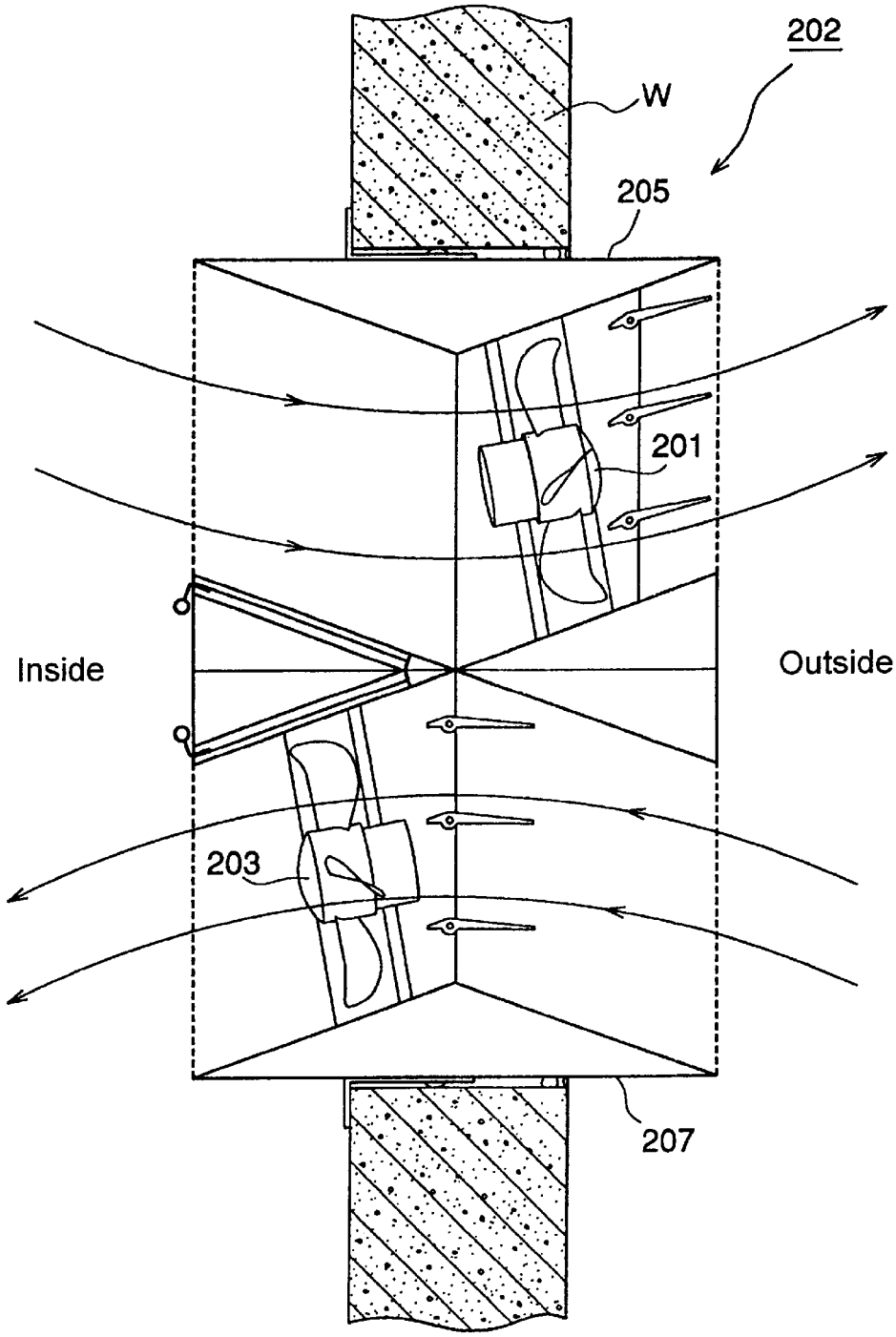
FIG. 19 is a cross sectional view showing an example of modified version of the ventilation device in the third embodiment of the present invention.

In the ventilation device shown in FIG. 16, the fans 201 and 203 can be rotated in either backward or forward direction. If the rotating direction of each fan is fixed to only one direction, the position of the fan in the tubular body 200 can be determined in accordance with the rotating direction as fixed. For instance, in the ventilation device 202 shown in FIG. 19, the fan 201 is used exclusively for the air exhaustion and the fan 203 is used exclusively for the air intake. Accordingly, the fan 201 is provided at the outer (right side) position in the tubular body 205 and the fan 203 is provided at the inner (left side) position in the tubular body 207.

Figure 20:
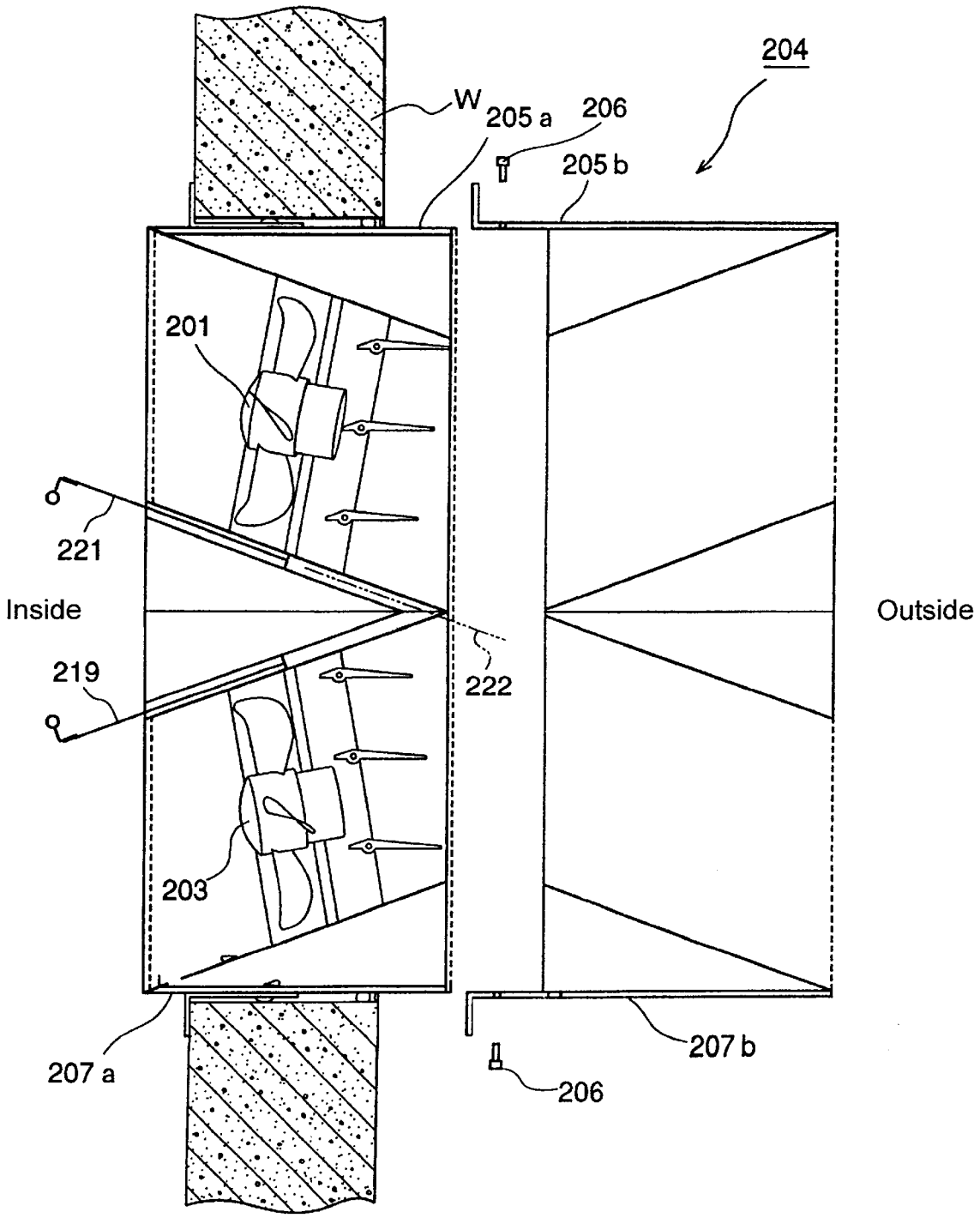
FIG. 20 is a cross sectional view showing another example of modified version of the ventilation device in the third embodiment of the present invention.

FIG. 20 shows an example of ventilation device, wherein the tubular body is divided into two. The ventilation device 204 is divided into inside tubular bodies 205*a* and 207*a* and outside tubular bodies 205*b* and 207*b*. As shown by the broken line 222 in FIG. 20, an extending plate 221 may be formed as projecting from the tubular body 205*a* in an upwardly inclined direction. Similarly, an extending plate 219 may be formed as projecting from the tubular body 207*a* in a downwardly inclined direction. In this ventilation device 204, only the inside tubular bodies 205*a* and 207*a* can be used.

Figure 21:
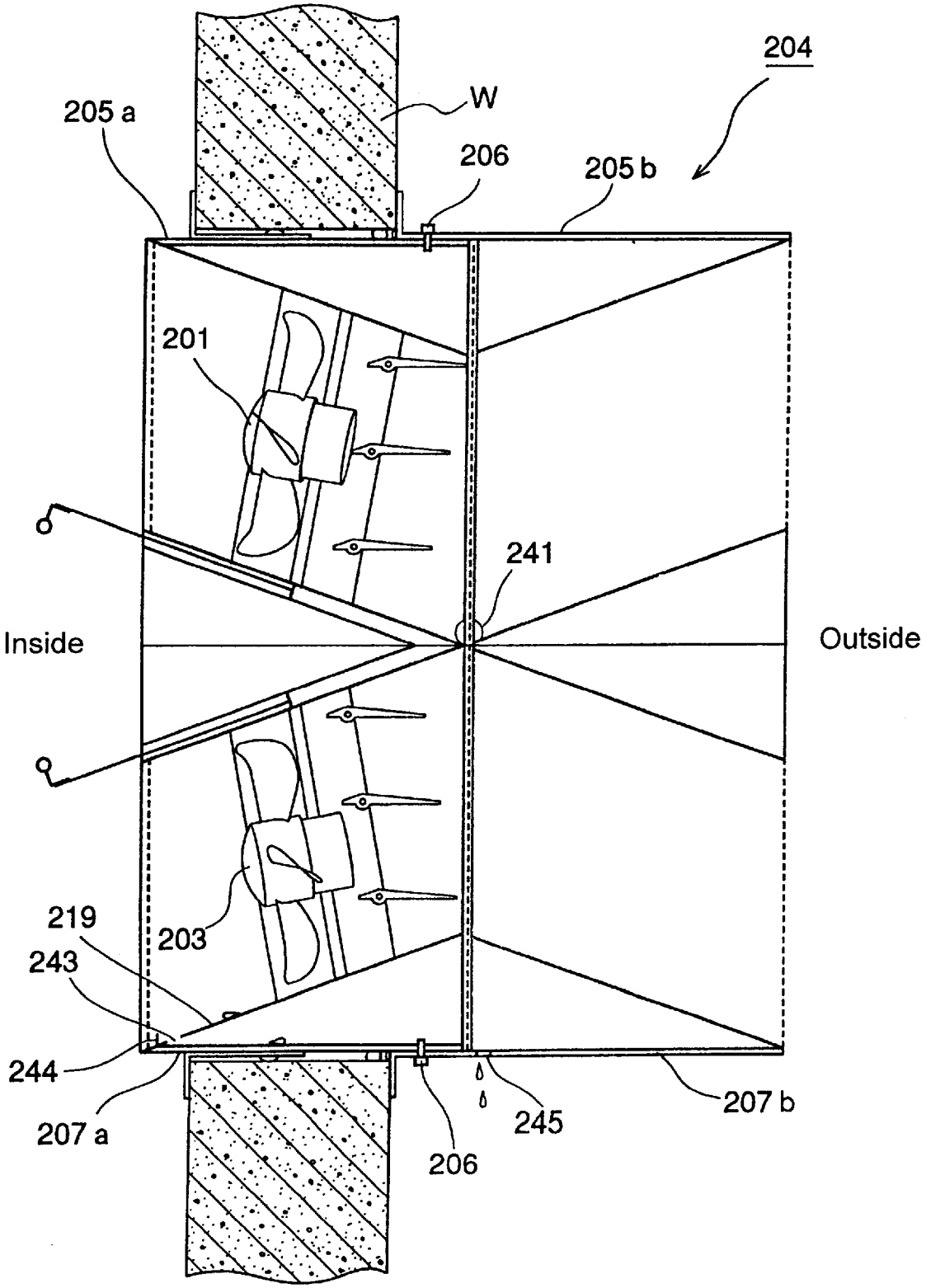
FIG. 21 is a cross sectional view of the ventilation device of FIG. 20 wherein an outside tubular body is attached to the ventilation device.

Alternatively, as shown in FIG. 21, both the inside tubular bodies 205*a* and 207*a* and the outside tubular bodies 205*b* and 207*b* may be connected with each other by fasteners such as bolts 206. By attaching the outside tubular bodies 205*b* and 207*b*, the air flows from the respective fans can be prevented from interfering with one another so that the ventilation effect can be enhanced. In this event, only one of the outside tubular bodies 205*b* or 207*b* may be attached to the ventilation device 204 depending on the circumstances. For example, if the wind or rain will not enter the room from the intake fan 201 in the tubular body 205*a*, attachment of only the outside tubular body 207*b* would be enough.

Referring to FIG. 21, the ventilation device 204 may be provided with holes 241, 243 and 245 for draining. An upward edge 244 is provided at the end of the regulating plate 219. By the upward edge 244, the rain/water entered from the outside is prevented from entering the room. If the water stays between the regulating plates 219 and the upward edge 244, the water is exhausted outside through the holes 243 and 245.

While the preferred embodiments of the present invention have been described above, the present invention is not limited to these embodiments and can be applied to various modifications and applications. For example, although the ventilation device of the present invention has been explained as the one used in a building, the ventilation device can be used in all of the constructions such as ships, airplanes and automobiles which may require ventilation of the inside air. In addition, although the tubular body 53 has been explained as a square shaped tubular body, the shape of the tubular body is not limited to square, but may take various other shapes such as a cylindrical shape.

Further, the cassette filters in either one or both of the inside opening and outside opening can be replaced with closing plates. In such a situation, the closing plate may function as an inside cover. Under this arrangement, the cover 13 may be omitted so that a more simplified and inexpensive ventilation device can be achieved.

What is claimed is:

1. A ventilation device to be mounted on a wall of a room for ventilating air within the room or between inside and outside of the room, comprising:

a tubular body extending between the inside and outside of the room, the tubular body installing a first fan therein at about the inside of the room and a third fan therein at about a middle of inside and outside ends thereof;

an air duct provided with close proximity to the tubular body for establishing an air flow path between inside and outside of the room;

a fan compartment provided at an end of the air duct positioned inside of the room and having a second fan therein, said second fan is inclined in a direction intermediate of a longitudinal direction of the air duct and a direction to the first fan;

wherein said fan compartment establishes a first air passage to said tubular body through a second air hole and a second air passage to said air duct through a first air hole;

wherein said first and third fans stored in the tubular body rotate in a direction opposite to a rotating direction of the second fan stored in the fan compartment, thereby producing a first air flow which circulates inside of the room via said first air passage caused by the first and second fans, a second air flow passing through the air duct via said second air passage caused by the second fan, and a third air flow passing through the tubular body caused by the first and third fans.

2. A ventilation device as defined in claim 1, wherein said first and third fans in said tubular body rotate either directions for exhausting inside air or intaking outside air, and said second fan in said air duct rotates either directions for exhausting inside air or intaking outside air, and when said first and third fans are set to rotate for exhausting the inside air, the second fan is set to rotate for intaking the outside air, and vice-versa.

3. A ventilation device as defined in claim 1, further comprising a first plate which is inserted in said ventilation device for either opening or closing said first air passage and a second plate which is inserted in said ventilation device for either opening or closing said second air passage.

4. A ventilation device as defined in claim 1, further comprising at least one filter either on the tubular body or on the air duct for cleaning air coming in the room.

5. A ventilation device as defined in claim 1, further comprising a heater, said heater being detachably mounted on an opening portion of said tubular body located inside of the room.

6. A ventilation device as defined in claim 5, wherein said heater has a flat shape to be installed in a slit provided in said opening portion of said tubular body, said heater in said slit being positioned at an end portion of said tubular body inside of the room.

7. A ventilation device as described in claim 1, further comprising a cover provided at the opening portion of said tubular body to be placed inside the room, wherein a top portion of said cover is rotatable fixed to said tubular body so that said cover may be opened and/or closed by rotating around the top portion thereof.

8. A ventilation device as defined in claim 7, wherein an angle of said cover is adjustable by rotating around the top portion of said tubular body to regulate directions of air flows in the room.

* * * * *